United States Patent [19]

Philip

[11] 3,945,223

[45] Mar. 23, 1976

[54] APPARATUS AND METHOD OF KNITTING AND ELEMENTS THEREOF

[76] Inventor: Morris Philip, 2519 Grand Ave., Bronx, N.Y. 10468

[22] Filed: Apr. 4, 1975

[21] Appl. No.: 565,226

Related U.S. Application Data

[63] Continuation of Ser. No. 315,237, Dec. 14, 1972, abandoned.

[52] U.S. Cl. ..... 66/50 R

[51] Int. Cl.[2] D04B 9/00; D04B 15/74; D04B 15/76; D04B 15/78

[58] Field of Search ..... 66/50 R, 50 A, 50 B, 42, 66/25, 75, 115, 8

[56] References Cited

UNITED STATES PATENTS

| | | | |
|---|---|---|---|
| 1,737,598 | 12/1929 | Lombardi | 66/50 B X |
| 1,947,558 | 2/1934 | Lombardi | 66/50 B |
| 1,970,238 | 8/1934 | Kretser | 66/50 A |
| 1,972,044 | 8/1934 | Howie | 66/50 R |
| 2,721,460 | 10/1955 | Lombardi | 66/50 R |
| 2,913,887 | 11/1959 | Ducharme | 66/50 B |
| 3,646,779 | 3/1972 | Nuber et al. | 66/2 J |
| 3,793,850 | 2/1974 | Wills-Moren et al. | 66/50 R |

FOREIGN PATENTS OR APPLICATIONS

| | | | |
|---|---|---|---|
| 585,557 | 12/1924 | France | 66/50 A |
| 478,814 | 7/1929 | Germany | 66/50 B |
| 716,444 | 1/1942 | Germany | 66/50 R |
| 6,235 | 3/1887 | United Kingdom | 66/115 |
| 375,351 | 6/1932 | United Kingdom | 66/75 |
| 919,173 | 2/1963 | United Kingdom | 66/42 |
| 1,140,839 | 1/1969 | United Kingdom | 66/8 |

OTHER PUBLICATIONS

The Hosiery Trade Journal, July 1971, Vol. 78 No. 931, p. 114.

*Primary Examiner*—Ronald Feldbaum

[57] ABSTRACT

A needle bed is provided with laterally spaced apart longitudinally extending needle grooves in which there is slidably positioned a needle, a jack and a multiplier rocker between the jack and the needle, the rocker pivoting forwardly-rearwardly about a pintle inwardly of the bed. The jack has a contact at its forward end which contacts the rocker between the pintle and the outer rocker end and the rocker has a contact near its outer end for contacting the rear of the needle whereby forward movement of the jack pivots the rocker to cause the rocker to move the needle forwardly a greater distance than did the jack. Each jack is provided with a control butt and at least one pattern butt, each jack having plural sites at which a pattern butt can be located. The cam portion for actuating the jacks and needles has a multiple patterning raceway having longitudinally spaced apart pattern camming segments individually movable between an operative and an inoperative position. A pattern camming segment at an operative position will coact with a pattern butt at a corresponding site to move the jack forwardly sufficiently to move the corresponding needle from the welt position to the tuck position. The cam portion also has a needle butt raceway including camming for optionally moving needles forwardly from the tuck position to the clearing position and for moving each needle from its forward position rearwardly to the cast off position. The cam portion also has a jack butt raceway including camming for cooperating with the control butt on the jack for moving the jack from its rearward position sufficiently forwardly to move its corresponding needle from the cast off position to the welt position. The camming of the jack butt raceway also returns each jack from its forward position to its rearward position no later than the needle corresponding thereto is returned to the cast off position.

54 Claims, 19 Drawing Figures

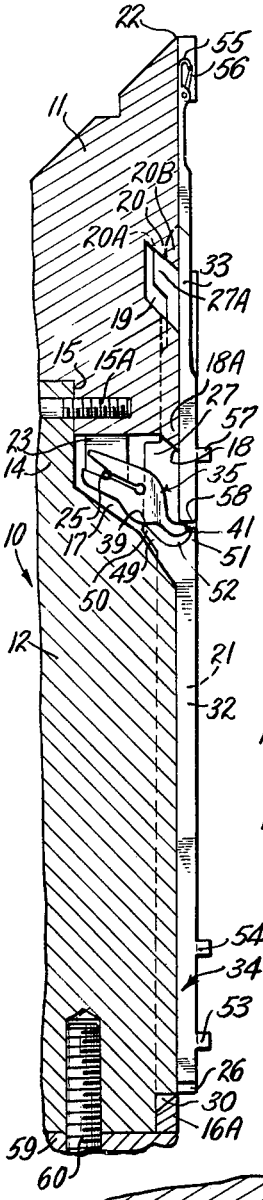
Fig. 7.
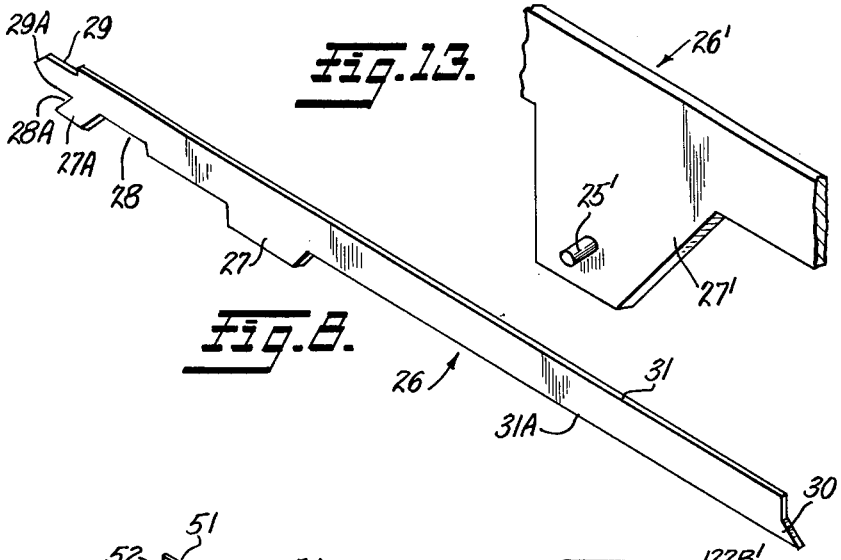
Fig. 8.
Fig. 13.
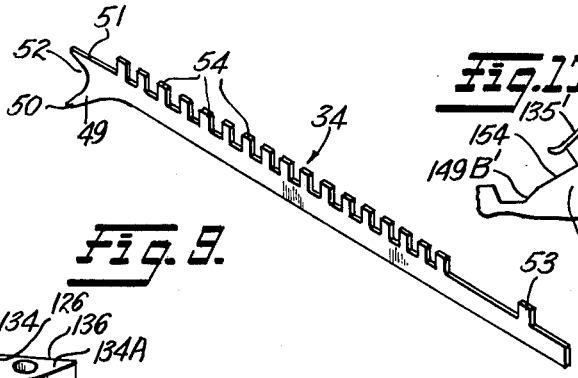
Fig. 9.
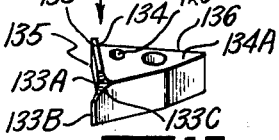
Fig. 16.
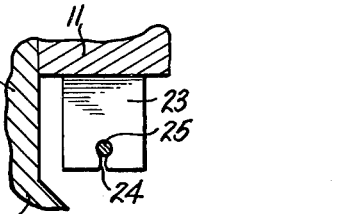
Fig. 17.
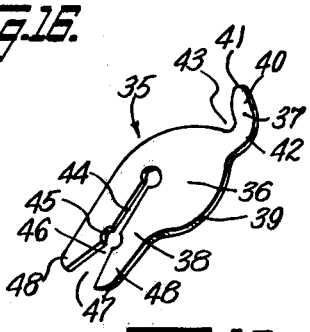
Fig. 10.
Fig. 14.
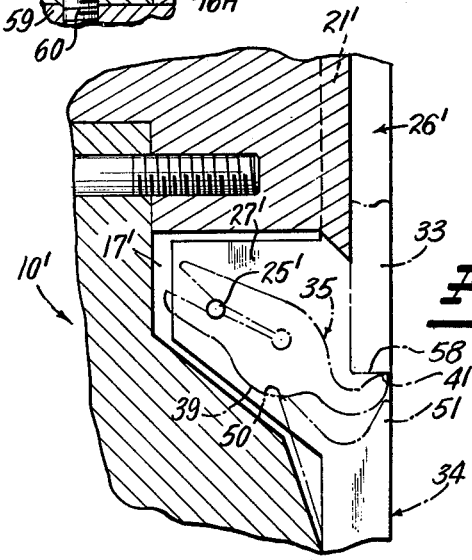
Fig. 12.
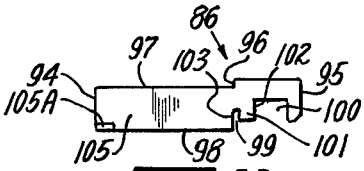
Fig. 11.

APPARATUS AND METHOD OF KNITTING AND ELEMENTS THEREOF

This is a continuation, of application Ser. No. 315,237, filed Dec. 14, 1972 now abandoned.

The present invention is directed to an apparatus and method of knitting and elements thereof. More particularly, it is directed to a needle bed having a particular arrangement of needles and jacks, the camming for operating such needles and jacks, as well as various elements of the apparatus and the method of knitting.

In recent years there has been a great increase in the demand for knitted fabrics containing patterns or designs, especially for those known as jacquard patterns. In order to meet this demand, there has been a desire to increase the productivity of the knitting machines and at the same time to increase the versatility of the machines in the production of patterns. Such fabrics are primarily produced on multifeed circular knitting machines, comprising one or more needle beds. The needles of such machines are actuated by cam assemblies and a portion of a cam assembly containing all the camming elements for knitting one course is called a cam portion. Each cam portion feeds one yarn to the bank of needles during each revolution of the machine and therefore each cam portion is usually called a yarn feed. The number of yarn feeds in the cam assembly determines the number of courses which the machine knits each revolution. Obviously, an increase in the number of yarn feeds increases the number of courses knit during each revolution. However, because of space requirements and other physical limitations in the machine, the maximum number of yarn feeds in prior art machines has been limited.

In general, the width of a cam portion or yarn feed, this being the distance from leading end to trailing end of the cam portion, determines the number of yarn feeds which a particular machine can accommodate. The width of the cam portion is, in turn, related to the camming angles of the cams. During each knitting cycle needles go through a projection cycle and a retraction cycle. Since, according to the invention, the improvements are made in the projection cycle, only such projection cycle need be discussed at this time. If, by way of example, the camming angle of the projection part of the cam portion is 45° and the needles, in the projection cycle, are projected about one inch, it will be appreciated that such projection part of the cam portion will have to be about one inch in width and about one inch in height. The height of the projection part of the cam portion is the longitudinal distance or spacing between the leading end and trailing end and is normally equal to the distance the needles are projected. Obviously, an increase in the camming angle will serve to reduce the width of the projection part of the cam portion and thereby reduce the width of the entire cam portion. However, an increase in camming angle does not effect the height of the camming. Because of problems inherent in the knitting operation, camming angles cannot be significantly increased.

According to one aspect of the invention, although the camming angle is not increased, means are provided for increasing the camming effect produced by the camming angles used during the projection cycle. This is accomplished by providing means for projecting the needles a greater distance than they would normally be projected with the camming angles used. This produces two results. First, it reduces the cam width and thereby enables the number of yarn feeds to be increased. Secondly, there is a reduction in the height of the camming necessary to produce a needle projection of any given distance.

More specifically, according to one aspect of the invention, the needles are projected at least a portion of their projection cycle by means of jacks acting on the needles through distance multipliers. The camming projects the jacks, the jacks acting against the distance multipliers which, in turn, act against the needles to project the needles a further distance than the jacks were projected. The construction of the multiplier is such that the needles can be projected more than twice the projection distance of the jack. This multiplication of the projection distance produces an effect equivalent to increasing the camming angle, thereby reducing the width of the part of the cam portion used to project the needles and permitting the use of more yarn feeds. It is noted that although this effect is the same as would be produced by increasing the camming angle, the camming angle cannot actually be increased sufficiently to permit a similar amount of reduction of cam width. Stated differently, the camming angles used in the projection cycle cannot be significantly increased beyond 45°. In addition to producing an effect equivalent to increasing the camming angles, the use of the multiplier permits the camming height to be reduced because the camming height, although equal to the distance the jacks are projected, is less than the distance the needles are projected. This result cannot be obtained by increasing the camming angles even if machine construction could permit the use of increased camming angles. In the illustrated embodiment the distance multiplier does not project from the needle bed. Although multiplier devices have been proposed, such multipliers are outside the needle bed and such multipliers are not acted on by jacks so as to augment the distance the needles are projected relative to the distance the jacks are projected.

Many devices have been used to increase the patterning ability of the machine. In order to produce patterns, in selected courses selected needles must have a different movement cycle from needles in that course or in other courses, the selection depending upon the pattern desired. The patterning versatility is also a function of the number of yarn feeds. One system for producing patterns involves providing the camming with plural raceways, each raceway being a complete raceway for acting on butts of selected needles, so that the needles move through cycles as determined by the raceway which actuates them. Since each raceway is a complete raceway, the height of the cam portion is obviously increased over the height of a single raceway cam. Because of space limitations, it is impractical to have more than three such complete raceways.

It is obvious that an increase in the number of raceways will increase the patterning ability of the machine. According to another aspect of the invention, the number of effective pattern raceways is greatly increased while keeping the total height of the cam portion at a convenient limit. This is accomplished by separating the movement cycle of the needles into a plurality of stages and providing a multiple patterning raceway which functions only during part or all of the projection cycle, with the remainder of the movement cycle of the needles being effected by at least one additional raceway. In the preferred embodiment of the invention, the pattern camming elements of the multiple patterning raceway only act to move the needles from the welt position to the tuck position. By providing a plurality of pattern cam sites in the multiple pattern raceway, each site providing the effect of a raceway, and selecting the sites at which the cam elements are located, there can be obtained the desired patterning for each cam portion. In the preferred aspect of the invention, the multiple patterning raceway is used together with the multiplier previously mentioned, thereby reducing the height of the individual pattern cam elements and therefore reducing the height of the entire cam portion. In such a combination there can be provided the equivalent of seventeen patterning raceways in a cam portion height about that of prior art machines having three complete patterning raceways.

It is pointed out that in a machine where each revolution repeats the pattern knit in the previous revolution, an increased number of yarn feeds increases the number of courses over which a pattern can be distributed before the pattern repeats. An increase in the number of selections possible increases the number of wales over which a pattern can be spread. It is apparent, therefore, that the present invention provides not only increased productivity of fabric per revolution of machine, but provides increased versatility or flexibility of patterning.

It is therefore an object of the present invention to provide a means and method for increasing the camming effect of the cams during the projection of the needles so as to reduce the width of the cam portion.

It is another object of the invention to provide a means and method for increasing the camming effect of the cams during the projection of the needles so as to reduce the height of the camming required for effecting such projection.

It is another object of the invention to provide a means and method for forwardly moving needles at least a portion of their projection cycle by means of jacks with the forward movement of the jacks being converted into a greater forward movement of the needles.

It is another object of the invention to provide movement multiplier means interposed between needles and jacks to cause the needles to move forwardly a greater distance than the jacks.

It is another object of the invention to provide a structure where the movement multiplier between the jacks and needles is located inwardly of the needle bed.

It is another object of the invention to increase the patterning ability of the knitting machine by providing a structure which greatly increases the number of needle selections possible for each cam portion without unduly increasing the height of the cam portion.

It is another object of the invention to increase the number of yarn feeds and at the same time increase the number of patterning combinations available.

It is still another object of the invention to provide a cam construction including a multiplier patterning raceway which produces the effect of a plurality of conventional raceways with said multiple patterning raceway occupying less height of the cam construction than the equivalent number of conventional complete raceways.

These and other objects and aspects of the invention will be readily apparent from the following description in connection with the accompanying drawings, wherein:

FIG. 1 is a fragmentary elevation of a portion of a dial and cylinder knitting machine wherein the needle bed is on the outer surface of the cylinder and wherein the cams surround the cylinder, the view being taken from outside the machine looking toward the needle bed, the dial being omitted with only some of the cylinder needles being diagrammatically shown. This figure shows one complete cam section and fragments of two adjacent ones;

FIG. 7 is a vertical cross section similar to FIG. 5, but showing the needle in the cast off position;

FIG. 8 is a perspective view of a needle groove wall;

FIG. 9 is a perspective view of a jack showing pattern butts at all the pattern butt sites;

FIG. 10 is a perspective view of the multiplier rocker;

FIG. 11 is an elevation of a pattern selector cam;

FIG. 12 is an enlarged fragmentary cross section corresponding to a portion of FIG. 7, showing a modification of the pintle means for the rocker;

FIG. 13 is an enlarged fragmentary perspective view of the needle groove wall used in the modification of FIG. 12;

FIG. 14 is an enlarged fragmentary cross section of the needle bed showing in detail the structure for mounting the pintle means of the embodiment of FIGS. 2, 5, 6 and 7;

FIG. 16 is a perspective view of the clearing cam;

FIG. 17 is a fragmentary elevation of the inner face of a cam section showing a modified needle cam construction.

Figure 1:
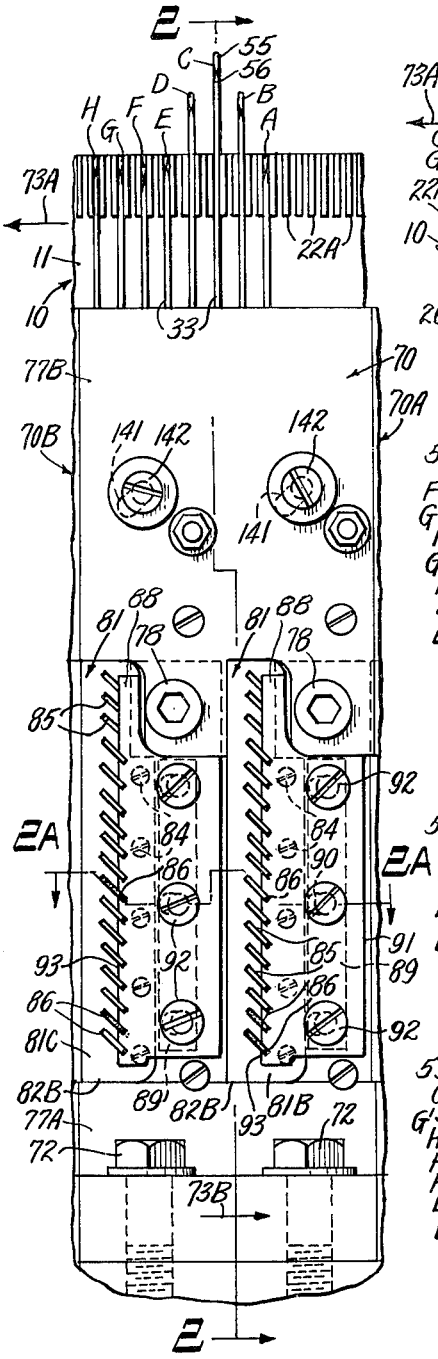

The drawings accompanying the application, except for FIGS. 3A, 12, 13 and 14, are substantially to scale and are substantially full size. Although a cylinder needle bed and its operative cams are actually circumferentially curved, they are shown in the accompanying drawings, except for FIG. 3A, as if they were flat, for purposes of clarity. As a practical matter, with a cylinder machine having a cylinder 30 inches in diameter, the curve of the portions shown in the accompanying drawings is not readily apparent.

The invention will be particularly described in connection with the cylinder needle bed of a multifeed dial and cylinder circular knitting machine. However, the invention can be used in connection with other types of multifeed knitting machines comprising a needle bed, whether or not there are additional needle beds and whether or not the invention is applied to more than one needle bed in such machine. Circular machines are of two types, in one type the needle beds are stationary with the cams rotating and in the other type, the needle beds rotate with the cams being stationary. The invention is applicable to both types, although it will be described in connection with a machine wherein the needle bed rotates and the cams are stationary. Therefore, it should be borne in mind that it is merely necessary to provide relative lateral movement between the needle bed and the cams. Furthermore, the cylinder needle bed can have the needles on the outer surface thereof with the cams being outside the cylinder or the cylinder can have the needles on the interior surface thereof with the cams being inside of the cylinder. Similarly, a dial can be constructed either with the needle hooks projecting from the outer periphery of the dial during the knitting operation or, alternatively, with the needle hooks projecting toward the center of the dial during the knitting operation. The illustrated embodiment will be directed to a cylinder wherein the needle grooves are on the outer surface with the cams being outside the cylinder.

Since the invention is applicable to various types of needle beds, it is highly desirable to use terminology appplicable to all these types. The hook end of the needle is the forward end and the other end of the needle is the rear end, the end of the needle bed from which the needle hooks project during knitting being the forward end, and the other end of the needle bed being the rear end. The forward direction is the direction away from the rear end of the needle bed toward the forward end and the rearward direction is the direction opposite the forward direction. "Longitudinal" is the forward-rearward direction along the length of the needle grooves and needles. In a conventional cylinder machine, the needle grooves are equidistantly spaced from each other throughout their length and the longitudinal direction is therefore constant throughout the needle bed. Normally, in a cylinder the longitudinal direction is the vertical and this is so in the accompanying drawings. In a dial the needle grooves are radially disposed so that the longitudinal direction is along the radials. "Lateral" is the direction across the needle grooves connecting corresponding points of each groove. In a cylinder the lateral direction is the horizontal and this is so in the accompanying drawings. In a dial the lateral direction is defined by a series of concentric circles or arcs. In both cylinder and dial the cams and the needle bed move relative to each other in the lateral direction. The outer side or face of a needle bed is the face or surface having the needle grooves and the inner side or face is the opposite side or face of the needle bed. Therefore, inwardly refers to a direction from the outer surface towards the inner surface, and outwardly refers to the opposite direction. "Transverse" refers to the inward-outward direction.

All the elements of the needle bed, needles, jacks, multiplier, etc., and all the elements of the cams will be described as if the machine is set up for operation and consistent terminology will be used throughout, so that, for example, the surface of the cams closest the needle grooves is the inner surface and the surface of the cams remote from the grooves in the outer surface. The inward and outward direction is always the same, whether referring to needle bed, cams or any elements thereof. Referring to a cylinder, the lateral direction is actually the circumferential direction. Nevertheless, it will occasionally be convenient to use the word "circumferential" primarily to indicate a structure which extends all around a needle bed.

THE NEEDLE BED AND BASIC OPERATION OF NEEDLES, JACKS AND MULTIPLIERS

As pointed out previously, the invention will be particularly described in connection with a dial and cylinder circular knitting machine wherein the cylinder needle bed has the novel construction of the invention.

Figure 2A:
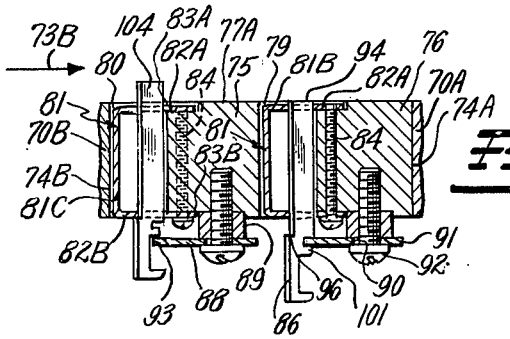
FIG. 2A is a fragmentary horizontal cross section taken along the line 2A—2A of FIG. 1, showing a cross section of the pattern camming with the needle bed and jacks omitted.
Figure 2:
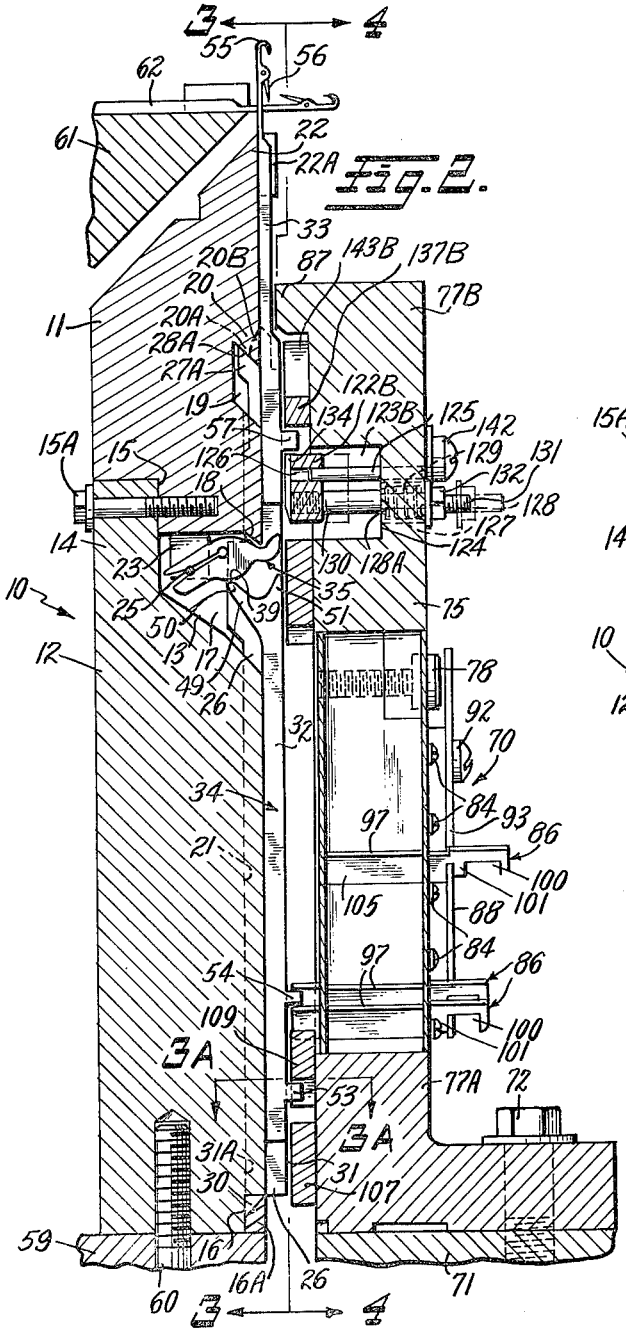
FIG. 2 is a fragmentary vertical cross section taken along the line 2—2 of FIG. 1, with a fragment of the dial being added. The cylinder needle shown therein is in the clearing position and for purposes of clarity only three pattern selector cams are shown in the cam support.

Referring particularly to FIG. 2, there is provided a cylinder needle bed 10 which in the illustrated embodiment, has a bed body comprising a circumferential forward body section 11 and a circumferential rear body section 12, the forward portion of the rear body section 12 being formed with a forwardly and inwardly inclined circumferential shoulder 13 which begins at the outer surface of the rear body section and extends inwardly to a forwardly projecting circumferential flange 14 at the inner side of the forward end of rear body section 12. The inner surface of the rear of the forward body section 11 is provided with a circumferential rabbet 15 for receiving the forward portion of the flange 14. Bolts 15A passing transversely through flange 14 and the rear of forward section 11 secure the two body sections together to provide a unitary needle bed body for needle bed 10. At the rear end of rear body section 12 there is provided a circumferential rabbet 16 extending inwardly from the outer surface. The transverse depth of rabbet 16 is relatively shallow, being of the order of ⅛ inch or so.

As can be seen from the drawings, the rear end of the forward body section 11 is spaced apart from the shoulder 13 to provide a circumferential space defining a circumferential open recess or access channel 17, said access channel 17 opening on the outer surface of the bed body. The rear end of the forward body section 11 is provided with a downwardly depending circumferential outwardly beveled rim or lip 18 which overhangs access channel 17 to reduce the longitudinal extent of the opening of access channel 17 at the outer side of the needle bed body. The forward body section 11 is provided, intermediate its forward and rear ends, with a circumferential recess 19 extending from the outer surface inwardly, the forward end of said recess being forwardly and inwardly inclined so as to provide a beveled lip or overhand 20. The transverse depth of recess 19 is somewhat greater than the depth of rabbet 16.

Figure 3:
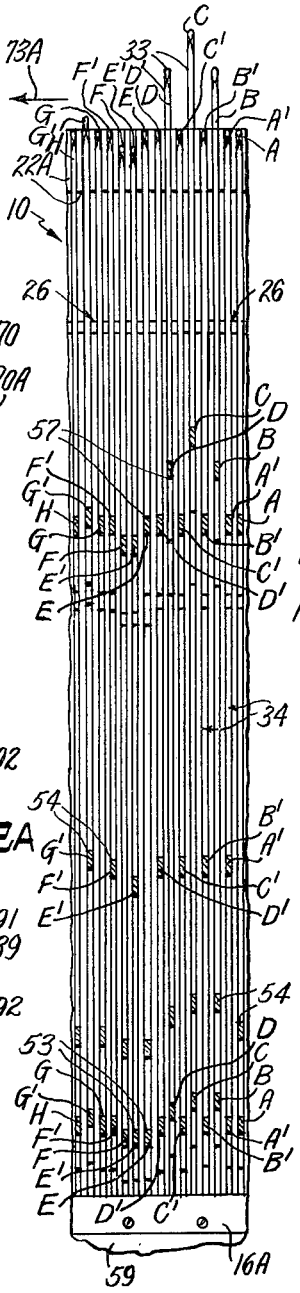
FIG. 3 is a fragmentary vertical section along the line 3—3 of FIG. 2, showing in elevation a portion of the cylinder bed together with the jacks and needles therein, the horizontal scale being somewhat distorted.
Figure 3A:
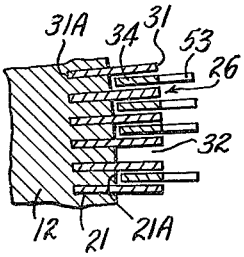
FIG. 3A is an enlarged fragmentary horizontal cross section taken along the line 3A—3A of FIG. 2, showing a portion of the needle bed and the jacks therein, one jack being omitted to show an empty needle groove.

A plurality of laterally spaced apart longitudinally extending grooves or channels 21 of uniform lateral width are cut into the bed body, each channel 21 extending from rabbet 16 forwardly until a short distance past overhang 20, the outer surface of the bed body between adjacent channels 21 defining lands 21A (see FIG. 3A). Obviously, such channels and lands are interrupted by access channel 17 and recess 19. The transverse depth of each channel is substantially uniform from the rabbet 16 to overhang 20, the depth being about that of the rabbet. The transverse depth of the channel is gradually reduced beginning at the rear edge of overhang 20. The cutting of the channels 21 into the needle bed body divides lip 18 into a plurality of spaced apart teeth 18A whose outer surfaces are part of the lands 21A. The cutting of the channels 21 also divides overhang 20 into contiguous alternating short teeth 20A and long teeth 20B, with each short tooth 20A lying beneath a channel and with each long tooth 20B extending between said channels, the outer surfaces of long teeth 20B being part of the lands 21A.

Beginning at the forward edge 22 of the needle bed body there are provided a plurality of laterally spaced apart outwardly and rearwardly extending combing teeth 22A, the combing teeth corresponding in number and being aligned with channels 21. The construction of the combing teeth is conventional and they may be either formed integrally with the needle bed body or, as more frequently constructed, comprise tempered hardened needle plates inserted in slots (not shown) at the forward end of the bed body. At the rear end of forward section 11 there are provided a plurality of laterally spaced apart downwardly depending transversely extending ears 23, said ears projecting into access channel 17 and corresponding in number to channels 21. Each ear 23 is aligned with a channel 21 and the spaces between adjacent ears are aligned with lands 21A, the lateral width of each ear 23 being substantially the same as the lateral width of channel 21. Each ear 23 has a notch or recess 24 (see FIG. 14) extending forwardly from the rear extremity of the ear, the notch extending laterally through the ear. A laterally extending wire or rod 25 is positioned in notches 24 so that said rod 25 passes through all the ears and the spaces therebetween. The metal at the opening of recess 24 rearward of the wire is then upset or peened to firmly secure the rod in each ear to prevent it from moving and from falling out of the notches 24. As will be later described, the portions of the rod 25 which extend laterally through the spaces between adjacent ears define pintle means about which a rocker can pivot.

In each channel 21 there is removably positioned an inserted needle groove wall 26 whose shape is clearly shown in FIG. 8, with FIGS. 2, 5, 6 and 7 showing the wall 26 inserted into the needle bed body. The position and location of the various elements of wall 26 with relation to the needle bed body are particularly clearly shown in FIG. 5. Each wall 26 is made of tempered steel of uniform thickness, the thickness being substantially equal to the width of channel 21 so that it can be wedged into channel 21 and frictionally held therein. Wall 26 is provided with a first inwardly extending tongue 27 which, as can be seen from FIG. 5, extends into access channel 17, and a second inwardly extending tongue 27A which is received within recess 19. Wall 26 is provided with a recess 28 rearwardly of tongue 27A. The forward end of wall 26 is provided with a notch 28A corresponding in shape to short tooth 20A so that said tooth can be received within said notch. The outer edge of wall 26 is recessed at 29 and then is provided with an inwardly and forwardly extending bevel 29A. A tail 30 is provided at the inner side of the rear end of wall 26, said tail lying in rabbet 16.

When a wall is inserted into groove 21, the forward end is placed into recess 19 until tooth 20A is seated in notch 28A, recess 28 providing clearance for this operation. Then the remainder of wall 26 is forced into channel 21. A plurality of laterally extending cover members or plates 16A are then fastened in rabbet 16 by bolts (not shown), said plates overlying the tails 30 of the walls to firmly keep the walls in place. The cover plates 16A have a lateral extent sufficient to extend across a plurality of walls, there being enough plates to cover all the walls. In this manner, when a wall has to be replaced only the cover plate for the lateral portion of the needle bed body need be removed. The distance between outer edge 31 and inner edge 31A is such that when the walls are inserted into channels 21, each wall will extend outwardly from the needle bed body a distance of the order of 3/16 inch or so, the outer edges 31 of the walls being aligned.

The portions of wall 26 extending from the surface of the needle bed body define the walls of longitudinally extending needle grooves 32 with the lands 21A between the walls defining the bottoms of the needle channels or grooves 32 (see FIG. 3A). Each ear 23 was originally aligned with a channel 21, and each ear 23 is therefore now aligned with a wall 26. Since there are no lands or groove bottoms 21A opposite access channel 17, it will be appreciated that each needle groove 32, where it crosses access channel 17, in effect extends inwardly between tongues 27 of adjacent walls 26 and extends further inwardly to the space between adjacent ears 23 with such inwardly extended groove being interrupted only by the lateral portion of rod 25 defining the pintle means.

It is pointed out that the structure of the walls 26 and the described method of inserting them in the grooves 21 is conventional, except for the addition of tongue 27. Conventional needle beds would have no access channel 17 and therefore there would be no tongue 27.

The structure which has been described above, namely, forward body section 11, rear body section 12, ears 23, and walls 26, comprise the structure defining needle bed 10 to thereby provide a needle bed having a plurality of laterally spaced apart longitudinally extending needle grooves 32, the outer edges 31 of the walls 26 defining the outer face or surface of needle bed 10. In the illustrated embodiment one of the purposes of providing teeth 18A and teeth 20B is so that their outer surfaces, which comprise lands 21A, serve to increase the longitudinal extent of the bottoms of the needle grooves 32 to provide the maximum bearing surface for the inner surface of the needles during the knitting operation. It is also noted that the pintle means defined by rod 25 are located in the needle bed inwardly of the bottoms 21A of the needle grooves 32.

At this point it is convenient to described an alternative needle bed construction (see FIGS. 12 and 13). In the alternative construction the ears 23 and the rod 25 are omitted and the inserted needle walls are slightly modified. In the modification, needle bed 10' is provided with walls 26' each having a tongue 27' which extends inwardly into access channel 17' a greater distance than corresponding tongue 27 on wall 26 extended into access channel 17. Near the inner end of wall 27' there is provided a laterally extending stud 25' which is slightly shorter than the lateral space between adjacent channels 21'. Therefore, when these walls 26' are inserted into the needle bed body the stud 25' on one wall 26' extends substantially to the next wall 26' so that said stud 25' constitutes the pintle means. Therefore, in both embodiments the pintle means extends at least part way across the needle groove.

This alternative construction is particularly advantageous for several reasons. First, in the embodiment shown in FIGS. 2, 5, 6 and 7, in the event the rod 25 breaks it is necessary to dismantle substantially the entire needle bed to replace the rod. In the alternative embodiment shown in FIGS. 12 and 13, if a stud 25' breaks it is merely necessary to remove that wall 26' and replace it with a new wall. A second advantage is that it renders it possible to more easily make the needle bed body in one piece. Because of the ears 23 in the first described embodiment, it is difficult to machine the needle bed body in one piece and this is why two body sections 11 and 12 are provided. It will be appreciated that the two embodiments, when each is assembled, are full equivalents so that the needle bed 10 shown in FIGS. 2, 5, 6 and 7 can be replaced by needle bed 10' and whenever any further reference is made to needle bed 10, it will be understood that needle bed 10' can be substituted without any other changes being required, unless the contrary is clearly stated.

In each needle groove 32 there is inserted an arrangement comprising a needle 33, a jack 34 and a movement multiplier rocker 35 between the needle and the jack. Although each needle groove 32 accommodates a needle, jack and rocker, such groove 32 can still appropriately be called a needle groove since this is conventional terminology in the art. It is also noted that the terminology which will be used in connection with the description of these elements, such as "inward", "outward", "rearward", "forward", "longitudinally", etc., are used when considering these elements in their position in the needle bed.

The multiplier rocker 35 is a flat metal plate having a thickness such that it can freely slide in the needle groove 32 and shaped, as can be seen from FIG. 10, somewhat like an inverted duck having an intermediate portion 36, an outer portion or neck 37 and an inner portion 38. The intermediate portion has a convexly curved rear surface defining a rearwardly facing first rocker contact 39. The outer portion or neck 37 is curved and extends outwardly from the intermediate portion terminating in a free end 40 having a forwardly facing edge defining a second rocker contact 41. The rear edge 42 of the neck is convex with the forward surface of the neck being concave and defining a recess 43. The inner portion of the rocker extends inwardly from the intermediate portion and is provided with a slot or keyway 44 extending outwardly from the inner end. The keyway 44 is provided with an enlargement intermediate its ends, said enlargement defining a bearing 45 for receiving the pintle means defined by rod 25 or stud 25', said keyway immediately outwardly of said bearing being narrower than the diameter of said pintle. Immediately inwardly of said bearing, at 46, the keyway 44 is also narrower than the diameter of the pintle, with the size of the keyway gradually increasing inwardly of the bearing until the size of the keyway is greater than the diameter of the pintle to thereby provide an entry 47 for easily receiving the pintle. The keyway divides the inner portion 38 into two opposed arms 48 capable, by virtue of the resiliency of the metal of the rocker, of being temporarily resiliently urged apart sufficiently to permit the pintle to pass from the entry into the bearing, the arms then snapping to their original position to releasably lock the pintle in the bearing. The diameter of the bearing is just sufficiently greater than the diameter of the pintle to permit the rocker to freely pivot about the pintle. A rocker is inserted into each needle groove 32 at a position aligned with access channel 17 until the pintle is received within the rocker entry 47 and then the rocker is slid further inwardly until the pintle snaps into the bearing. When so mounted in the needle bed, the rocker is free to oscillate, forwardly-rearwardly about the pivot axis defined by pintle, in the plane of the needle channel, said first and second rocker contacts similarly oscillating. It is pointed out that the opposed tongues 27 which define the needle groove walls act as lateral bearing surfaces for the rocker during its oscillation. If a rocker need be replaced, it can easily be snapped out.

In the rear of each needle groove 32 there is slidably positioned a jack 34 provided at its forward end with an inwardly and forwardly extending wing 49 which terminates in a forwardly directed free end whose forward edge defines a jack contact 50 (see FIG. 9). Another forwardly extending wing 51 is provided at the outer edge of the jack with wings 49 and 51 being transversely spaced apart so as to provide a recess 52 at the forward end of the jack outwardly of the jack contact 49. Each jack 34 is provided with butt means which, in the illustrated embodiment, comprise at least one outwardly extending control butt 53 and one or more outwardly extending pattern butts 54 longitudinally spaced apart from each other and from control butt 53. Referring to FIG. 9, it will be noted that there are seventeen longitudinally equidistantly spaced pattern butts 54, the location of each butt defining a pattern butt site. In actual operation of the machine one or more of these butts will not be provided. FIG. 9 is an example of a jack which could be supplied to the user of the machine and the user will grind off whichever pattern butts 54 are not to be used. Alternatively, the user of the machine can be provided with jacks having pattern butts only at the desired site or sites. The purpose of these pattern butts 54 and the arrangement thereof will be explained later.

Each jack is inserted into a needle groove 32 with wing 49 extending into access channel 17 as shown in FIGS. 2, 5, 6 and 7, the wing 49 being rearward of the rocker 35. Forwardly of rocker 35 there is slidably positioned a needle 33 having at its forward end a hook 55 and a latch 56. Each needle is provided with needle butt means comprising at least one outwardly extending needle butt 57. The jacks and needles are slidable in the grooves for forward-rearward reciprocation.

The function and operation of the needles, jacks and rockers will now be briefly described in connection with FIGS. 2, 5, 6 and 7. When the jacks and needles are positioned in the needle bed, their outer edges are slightly inward of the outer edge 31 of the walls which define the needle grooves 32, with only the butts on the jacks and needles projecting outwardly from the outer edges 31. A jack, needle and rocker in the same groove 32 are coplanar and are said to correspond to each other. In this brief description, reference will be made to the corresponding elements in the single needle groove 32. Referring to FIG. 7, each of jack 34, rocker 35 and needle 33 are shown in their rearward position, the hook 55 of the needle being retracted into the cylinder, being rearward of the forward edge 22 of the cylinder, at which location the needle is in the cast off position. Note that the rear edge of the needle abuts or rests on second rocker contact 41, the rear edge of the needle defining a rearwardly facing needle contact 58 at the rear end of the needle which abuts or is abutted by second rocker contact 41. Also note that the curved rear edge 42 of the rocker neck is received within recess 52 at the forward end of the jack.

These parts have been shaped as illustrated so as to minimize the longitudinal extent of the portion of the needle groove which they occupy. The rear edge of the needle outwardly of needle contact 58 is very close to, but does not make contact with, the forward edge of wing 51 of the jack. Wing 51 has no function in the movement process, serving only to help keep the jack in the groove, as will be later described. Jack contact 50 abuts the convex rear surface of the rocker which defines first rocker contact 39. Any conventional camming forces can be used to move the jack 34 forwardly. For example, it can be moved by another jack located further rearwardly. However, in the illustrated form of the invention, jack 34 is moved forwardly by the application of first camming forces to control butt 53. When such first camming forces are applied jack 34 is moved forwardly a short distance from the position shown in FIG. 7 to the position shown in FIG. 5 and, of course, jack contact 50 moves forwardly the same distance. During this first forward movement jack contact 50 constantly abuts first rocker contact 39 to cause the rocker to pivot forwardly about the pintle. The forward pivoting of rocker 35 in turn moves second rocker contact 41 forwardly and during this forward movement the second rocker contact 41 makes continuous contact with the needle contact 58 to urge the corresponding needle forwardly to the welt position wherein the needle hook is about flush with the forward edge 22 of the needle bed. As will be explained hereinafter, because of the multiplying effect of the rocker the needle moves forwardly a greater distance than did the jack.

Figure 5:
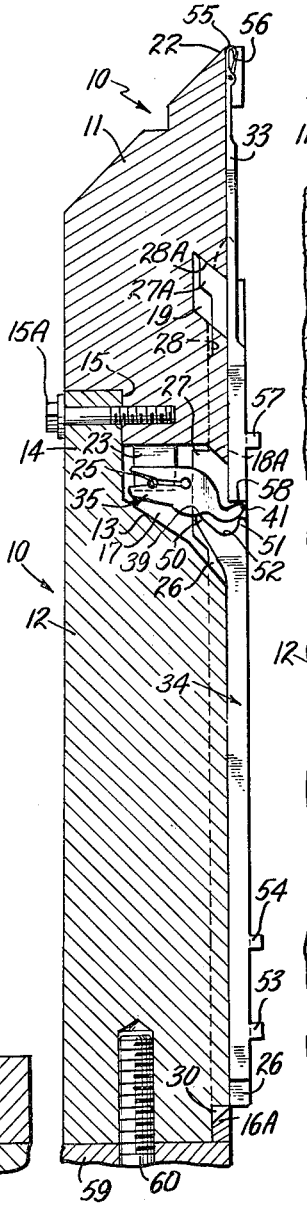
FIG. 5 is a fragmentary vertical cross section comparable to FIG. 2, but with the dial and camming omitted, and taken at a different section line so as to show a jack and its corresponding needle in a needle groove wherein the needle is at the welt position.
Figure 6:
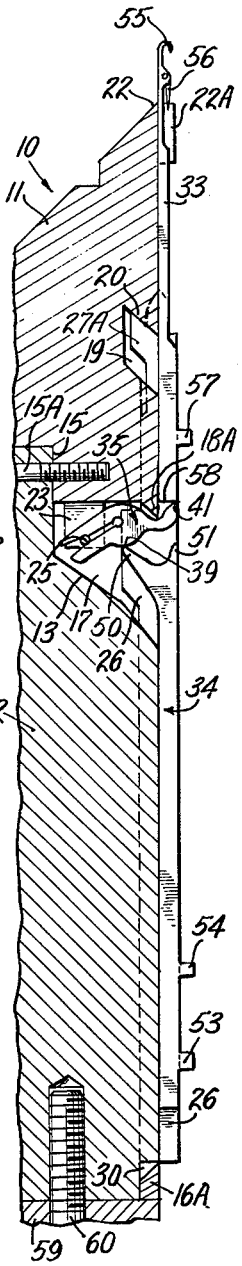
FIG. 6 is a vertical cross section similar to FIG. 5, but showing the needle in the tuck position.

Second camming forces are then applied to one of the pattern butts 54 of the jack to further move the jack forwardly from the position shown in FIG. 5 to FIG. 6, and during this movement jack contact 50 still abuts first rocker contact 39 to pivot the rocker further forwardly to further advance second rocker contact 41 which in turn, by virtue of its abutment with needle contact 58, advanaces the corresponding needle forwardly from the welt position to the tuck position, the needle again moving forwardly a greater distance than did the corresponding jack. In this position tooth 18A extends at least part way into recess 43 in the front surface of the rocker neck. In the embodiment illustrated in FIGS. 2, 5, 6 and 7, the jack cannot be moved further forwardly than the distance shown in FIG. 6, because such further movement would bring the forward surface of the rocker in contact with the rear surface of forward body section 11. In other words, in this embodiment movement of the jack cannot serve to project the needle further forwardly beyond the tuck position. In order to move the needle further forwardly to the clearing position the needle is moved independently of the jack by applying third camming forces to the butt 57 on the needle. FIG. 2 shows the movement of the needle after it has been moved by the third camming forces from the tuck position to the latch clearing position. Note that the jack and rocker in FIG. 2 remain in the same position as they were in in FIG. 6. It is also noted that because of the offset in section line 2—2 of FIG. 1 along which the cross section of FIG. 2 was taken, the needle shown in FIG. 2 does not correspond to the jack, since they are in different needle grooves. However, in cross sectional view the relationship between the needle and jack shown in FIG. 2 is the same as it would be if the needle and jack were in the same groove.

As soon as a needle reaches the tuck position, that shown in FIG. 6, the jack and rocker have fulfilled their function and the camming forces which were applied to the jack are removed or relieved, the jack and rocker not moving forwardly as the needle moves from the tuck to the clearing position. In the event it is desired, during knitting of a particular knitting cycle, that a particular needle only tucks and does not clear, the third camming forces are not applied to the butt on such needle and such needle remains in the position shown in FIG. 6. Thereafter, whether a needle is left at the tuck position (FIG. 6) or has been advanced to the clearing position (FIG. 2), fourth camming forces are applied to the needle butt 57 to move it rearwardly from its respective forward position (FIG. 6 or FIG. 2) to the cast off position and during this rearward movement needle contact 58 moves second rocker contact 41 rearwardly to pivot the rocker rearwardly so that first rocker contact 39 moves jack contact 50 rearwardly to move jack 34 rearwardly to its rearward position so that all the elements are once again in the position shown in FIG. 7. In a preferred embodiment of the invention, instead of utilizing the rearward movement of the needle to return the jack to its rearward position, fifth or return camming forces are applied to jack control butt 53 at any appropriate time after the jack has brought its corresponding needle to the tuck position to move the jack rearwardly to its rearward position no later than its corresponding needle is brought to the cast off position by the fourth camming forces. Further, in a preferred embodiment of the invention, if any needle is brought to the welt position (FIG. 5) and not advanced forwardly so that the needle does not knit, the fourth camming forces also move such needle rearwardly from the welt position to the cast off position.

Each time the needle is moved forwardly by the jack, because of the multiplying effect of the rocker, the needle moves forwardly a greater distance than did the jack. In other words, if a jack is moved forwardly a predetermined distance, the corresponding needle is moved forwardly by the multiplier a distance greater than the predetermined distance. It will be appreciated, of course, that the machine can be operated and designed so that the predetermined distance a jack moves is different from the predetermined distance another jack moves. The rocker produces a multiplying effect because the rocker acts as a lever whose fulcrum is the axis of the pintle. If the distance between the axis of the pintle and second rocker contact 41 is called A, and the distance between the pintle axis and jack contact 50 is called B, the multiplier effect is the ratio A/B. In the illustrated embodiment distance A is about 2.5 times distance B, giving a ratio of about 2.5. This means that each time a jack moves forwardly a certain distance the corresponding needle will move forwardly about 2.5 times that distance. The multiplier effect can be increased by moving jack contact 50 closer to the pintle. In the illustrated embodiment the needle is moved by direct contact with the rocker. Obviously, direct contact is not necessary. For example, another jack or jack-like element (not shown) can be interposed between the rear of the needle and the second rocker contact. It is merely necessary to provide rearwardly facing needle contact means for abutment by the second rocker contact to receive the movement of the rocker and to transmit the rocker movement to the needle. In the illustrated embodiment such needle contact means is represented by needle contact 58 on the needle itself.

The above description of the movement of the jack, rockers and needles briefly describes the function and effects of the various parts, particularly when actuated in the preferred manner. Other variations will be set forth in detail when describing the actual cooperation between the various elements and the novel camming of the invention.

One complete forward-rearward reciprocation of either the jack or the needle is called a movement cycle of the jack or needle. A movement cycle of the needle is called a knitting cycle when the needle in such cycle is moved forwardly at least to the tuck position (FIG. 6) because at the tuck the needle can pick up the yarn for that course. Therefore, a needle movement which starts at FIG. 7 (cast off), then successively proceeds forwardly to the position shown in FIG. 5 (welt) to FIG. 6 (tuck), optionally to FIG. 2 (clearing), and then rearwardly to the starting position, FIG. 7 (cast off) defines a knitting cycle. Since a movement cycle begins and ends at the same point, the beginning point of the cycle (also the end point) can be arbitrarily designated so that, for example, a knitting cycle can be considered to begin at the welt position (FIG. 5) and proceed successsively forwardly to tuck, optionally to clearing, then rearwardly to cast off and forwardly to welt. The welt position is a particularly good starting point for a cycle because a needle at welt is usually considered at rest. A movement cycle of a needle excluding the tuck position, such as one beginning at cast off, then forwardly to welt, then rearwardly to cast off, is not a knitting cycle, since such a needle cannot take on yarn. During a knitting cycle which includes clearing a needle must pass through the tuck position whether or not it pauses at tuck.

Needle bed 10 or 10' is secured to a conventional cylinder ring 59 (only a fragment is shown) by bolts 60. In the illustrated embodiment cylinder ring 59 rotates, thereby causing the cylinder or needle bed 10 to rotate. The construction of the cylinder ring 59 and means for rotating it are conventional and will not be further described or shown. For the purpose of orientation there is shown in FIG. 2 a small portion of the dial 61, the forward end of the dial 61 having dial needles 62 mounted thereon. The remainder of the dial and the structure of the dial camming are conventional and will not be further described or illustrated. Since the dial is not an essential part of the invention, the dial is not shown in any of the other figures. Of course, in machines in which the cylinder rotates the dial also rotates. If the distance multiplier effect as above described in desired for the dial, the dial can be constructed in substantially the same manner as the novel cylinder which has just been described.

THE CAMMING STRUCTURE AND OPERATION OF MACHINE

Although, as will be hereinafter pointed out, the novel jacks and needles can be operated with substantially conventional camming means, they are preferably operated by particular cam portions constituting another aspect of the invention.

Referring particularly to FIGS. 1, 2, 2A and 4, the machine is provided with a cylinder cam assembly comprising a plurality of particular cam sections 70, a cam section being a separate member which can independently be removably secured to cylinder cam ring 71 by bolts 72. Adjacent cam sections of the cam assembly substantially abut each other along their longitudinal margins to provide continuous camming raceways and in FIGS. 1 and 4 there are shown fragmentary portions of two cam sections 70A and 70B between which completely illustrated cam section 70 is positioned. As previously described, in the illustrated embodiment the cylinder rotates and therefore cam ring 71 is stationary. If the cylinder were stationary, the cam ring would be rotated about the cylinder in the conventional manner. In either event, the cam assembly moves relatively to the cylinder and in the drawings arrow 73A shows the direction of relative movement of the cylinder and arrow 73B shows the direction of relative movement of the cam assembly. In view of this, cam section 70A is the section which moves or operates the needles before cam section 70 operates them and therefore cam section 70A is called the preceding cam section. Cam section 70B, called the following or subsequent cam section, moves the needles after cam section 70 moves them. In a similar manner the leading end, edge or surface of any particular element of a cam section is the end, edge or surface closest to the preceding cam section and the trailing end, edge, or surface is the one remote from the preceding cam section. Reference character 74A represents the trailing longitudinal margin or edge of cam section 70A, as well as the leading longitudinal margin or edge of cam section 70, and reference character 74B represents the trailing longitudinal margin or edge of cam section 70 as well as the leading longitudinal margin or edge of cam section 70B. That part of a cam assembly which has sufficient cam means for moving needles through one knitting cycle to knit one course during each revolution of the machine is called a cam portion and defines one yarm feed. As is well known in the art, a cam section may contain a part of a cam portion, or one or more complete cam portions, depending upon the design of the machine. In the illustrated embodiment, each cam section contains sufficient cam means for knitting two courses so that it consists of two cam portions and therefore defines two yarn feeds. The cam means of cam section 70 described herein begin at the tuck position so that each cam section has sufficient camming means for moving needles successively from tuck, to clearing (optional), to cast off, to welt, to tuck, to clearing (optional), to cast off, to welt, and finally to tuck.

The cylinder cam assembly surrounds the needle bed with the inner faces of the cam elements which constitute the camming means being as close as possible, when in the operative position, to the outer edges 31 of the walls 26 without actually touching such outer edges, the needle butts and jack butts extending outwardly into the cam raceways. In the following description, the cam section will be described as if it were in the cam assembly adjacent the needle bed and therefore an "inner" location will be a location closest to the needle bed and an "outer" location will be a location remote from the needle bed.

A camming surface is a surface of a cam element or cam track at an angle to the lateral and which cooperates with an edge of either a needle butt or a jack butt to move such needle or jack forwardly or rearwardly. A surface of a cam track or cam element which is lateral, i.e., horizontal in the drawings, cannot cooperate with a butt to move it forwardly or rearwardly and is therefore a dwell surface. A cover surface is a surface which can cooperate with an edge of a butt to limit or control movement of that butt in the direction which it is urged by a cam surface. Generally, a cover surface is opposed to a camming surface and cooperates with the edge of the butt opposed to the edge of that butt being cammed by the camming surface. A cover surface may be at an angle to the lateral or may be lateral. occasionally, a dwell surface may also act as a cover surface.

Each cam section 70 comprises a support 75 which, in the illustrated embodiment, comprises a cam support body 76 made up of rear body section 77A and forward body section 77B bolted together by bolts 78. Cam support body 76 is provided, intermediate its longitudinal edges, with a first longitudinally extending cutout 79 which extends transversely through the entire thickness of the cam support body. A similar longitudinally extending cutout 80 is provided at the trailing edge of cam section 70 so that cutout 80 has no longitudinal wall at the trailing edge. A longitudinally extending U-shaped insert 81 having transversely spaced apart parallel lateral webs 82A and 82B is inserted in each cutout 79 and 80, the longitudinal edges of webs 82A and 82B being received in longitudinal rabbets 83A and 83B, respectively, on the cam support body and secured thereto by bolts 84. For purposes of later discussion, the U-shaped insert 81 in cutout 79 is also identified as insert 81B, while the insert in cutout 80 is identified as insert 81C. Each U-shaped insert 81 is mounted in its cutout so that inner web 82A is substantially flush with the inner face of the cam support body and outer web 82B is substantially flush with the outer face of the cam support body. Each web 82A and 82B of each U-shaped insert is provided with an identical series of longitudinally equidistantly spaced apart parallel oblique slots, each slot being at an angle of about 45° to the lateral in the illustrated embodiment. Each slot 85 on web 82A is aligned with its opposed or corresponding slot 85 on web 82B, and each such pair of corresponding slots defines a transversely extending passageway or guide for slidably receiving a pattern cam element or selector 86.

The cam support body is provided at its forward end with an inwardly extending overhang 87. When the cam section is in its operative position adjacent the needle bed, the overhang 87 extends inwardly forwardly of recess 29 of inserted needle groove walls 26. The overhang performs no camming function but merely serves as a protective cover to keep stray materials out of the needle bed - cam interface. The cam support body 76 and the pair of U-shaped inserts 81 secured thereto define the cam support 75 on which the various cam elements are mounted.

Referring particularly to FIGS. 1, 2, 2A and 11, a longitudinally extending retainer plate 88 is mounted on the outer side of the cam support 75, said retainer plate being spaced apart from the cam support by spacer element 89. Retainer plate 88 is provided with a plurality of longitudinally spaced apart horizontally elongated bores 90 near its leading edge 91, each retainer plate being releasably fastened to the cam support by bolts 92 passing through bores 90 and in threaded engagement with the cam support. A retainer plate 88 is mounted adjacent each U-shaped insert 81 so that the trailing edge 93 of the retainer plate partially overhangs slots 85 of outer web 82B of that insert. When bolts 92 are loose, the horizontal bores 90 permit the retainer plate to be slid laterally between a first position and a second position, in the first position the trailing edge 93 of the retainer plate overhanging the slots 85 a greater extent than it does in the second position.

Each pattern cam element or selector 86 is provided, intermediate its inner edge 94 and outer edge 95, with a projecting shoulder or stop 96 projecting at its trailing edge 97. The cross sectional shape of the selector, inwardly of shoulder 96 is substantially the same as the shape of slot 85 in order to permit the selector to be slidable in the passageway opened by a pair of corresponding slots 85 and at the same time prevent any significant lateral and/or longitudinal movement of the selector when it is in its operative position. The selector is in the operative position when it has been moved inwardly until shoulder 96 abuts the outer surface of the outer web 82B adjacent slot 85, the inner edge 94 projecting inwardly from the inner face of the cam support sufficiently for the selector to perform its camming function (see the trailing element 86 at the left of FIG. 2A).

The leading edge 98 of the selector is provided with a first cutout 99 and a second cutout 100, said cutouts defining between them a foreshortened tongue 101. When a selector 86 is in the operative position and the retainer plate 88 is moved to its first position and the bolts 92 are tightened, the trailing edge 93 of the retainer plate overlaps the outer edge 102 of tongue 101, thereby preventing the selector from being slid outwardly and fixing the selector in the operative position. When the bolts 92 are loosened and the retainer plate 88 is slid laterally to its second position, the selector can be slid outwardly, because tongue 101 is foreshortened, the tongue passing the trailing edge 93 of the retainer plate, until surface 103 defining the inner edge of first cutout 99 abuts the trailing edge 93 to limit further outward movement of the selector and prevent its removal from the cam support. In this position the selector is in the inoperative position (see the leading selector at the right of FIG. 2A), wherein its inner edge 94 is substantially flush with the inner face of the cam support. The transverse dimension of the cutout 99 measured from surface 103 to tongue 101 is just sufficient for the cutout to receive therein the trailing edge 93 of the retainer. When the selector is in the inoperative position and retainer plate 88 is moved to its first position and the bolts 92 tightened, the trailing edge 93 of the retainer is received incutout 99 to keep the selector fixed in the inoperative position. If it is desired to remove or insert one or more selectors into the cam support, the bolts 92 and the retainer plate are removed. A U-shaped insert can have mounted therein any number of selectors (from zero to all) in the operative position, with the remainder in the inoperative position and the retainer plate for that insert when in its first position will lock every selector in the insert in its respective operative or inoperative position. Obviously, selectors may be omitted entirely from selected sites.

When a selector 86 is in the operative position, the leading surface thereof defines a forwardly directed camming surface 104, the trailing surface 105 having no camming function. The thickness of each selector at its leading edge 98 is reduced by providing a bevel 105A at the leading edge of the portion of the trailing surface 105 which extends inwardly from the inner face of the cam support when the selector is in the operative position.

Slots 85 and therefore the passageways defined by each pair of corresponding slots 85, and the selector 86 positioned therein, are longitudinally spaced apart so that the longitudinal distance between the leading or camming surface 104 of one selector 86 and the trailing surface 105 of the selector 86 immediately forwardly thereof is slightly greater than the longitudinal length of each jack pattern butt 54. In this manner, when two adjacent selectors 86 of a U-shaped insert 81 are in the operative position they can receive between them a pattern but 54 of a jack 34, the camming surface 104 of the rear selector coacting with said pattern butt to move jack 34 forwardly. This camming action provides the second camming forces previously described for moving a jack 34 a sufficient distance to move its corresponding needle from the welt position to the tuck position. In the embodiment just described, the selectors comprise jack pattern cam means for cooperating with pattern butts on jacks for moving the jacks forwardly a sufficient distance to move their corresponding needles from thewelt position to the tuck position. As will be described later in connection with the embodiment of FIG. 15, the jack pattern cam means can move the jacks sufficiently to move their corresponding needles past the tuck position. The purpose of bevel 105A is to increase the entranceway for the pattern butt between two adjacent selectors.

Each passageway defined by a pair of corresponding slots 85 in each insert 81 provides or defines a pattern cam site at which a pattern cam element or selector can be located. In the illustrated embodiment there are seventeen pairs of corresponding slots 85 so that the slots in each U-shaped insert 81 define seventeen longitudinally spaced apart pattern cam sites, the same number as the number of the pattern butt sites 54 of jack 34 shown in FIG. 9. The on center longitudinal spacing of the slots 85 and therefore of the selectors and pattern cam sites, is the same as the on center longitudinal spacing of the pattern butt sites 54 on jack 34. If each jack butt site is counted consecutively, calling the rearmost site the first site, and if each pattern cam site is similarly counted, it will be appreciated that the first pattern butt site corresponds tothe first pattern cam site, etc.

A pattern butt is considered aligned with a pattern cam site when a pattern butt 54 on that butt site and a selector 86 at that pattern cam site are so longitudinally located that, when the selector is about to operate that butt, that butt can be received within the entranceway defined by the leading edge of that selector and the leading edge of the selector at the site immediately forwardly thereof to enable the camming surface of the selector to coact with the butt. In the illustrated embodiment each of the pattern butt sites is aligned with each of the corresponding pattern cam sites at the time when the jack has been moved forwardly to the position wherein its corresponding needle is at the welt position. Therefore, during the relative movement of the cam portion and the needle bed, a selector in the operative position at any particular pattern cam site will only cooperate with a pattern butt at a corresponding pattern butt site. For example, if there is a selector in the operative position at the first pattern cam site, such selector will only cooperate with jacks having a pattern butt at the first pattern butt site and all jacks not having a pattern butt at the first site will not be moved by the selector at the first site. If a particular jack does not have a pattern butt at a site corresponding to a pattern cam site at which a cam portion has an operative selector, such jack will not be acted on by the selectors of that cam portion, and the corresponding needle will normally remain at welt position and not knit during the course represented by that cam portion.

The height of camming surface 104, that is, the longitudinal distance between the leading and trailing edges of the camming surface (the length of the longitudinal projection of the camming surface), is equal to the distance the jack is moved forwardly during the camming operation. The height of the camming surface of each selector must be such that the trailing edge of camming surface 104 does not extend forwardly past the location of the edge of jack butt 54 in the site corresponding to that of the selector immediately forwardly thereof. The purpose of this can be easily explained with reference to the first and second sites of the jack butts and of the selectors. If the first selector is in the operative position and the second selector is in the inoperative position, and there is a jack buttat the second pattern butt position but not at the first, such a jack will not be moved forwardly by the first selector. However, if the trailing edge of the camming surface of the first selector extends forwardly past the rear edge of the jack butt in the second position, such rear edge would strike the camming surface of the first selector near its trailing end although it is not supposed to. It is for this reason that the height of the selector camming surfaces must be within the limits set forth. It is apparent from the preceding description that the array of pattern cam sites, seventeen in the illustrated embodiment, defines a multiple patterning raceway 106 equivalent to seventeen raceways for receiving jack pattern butts 54.

Figure 4:
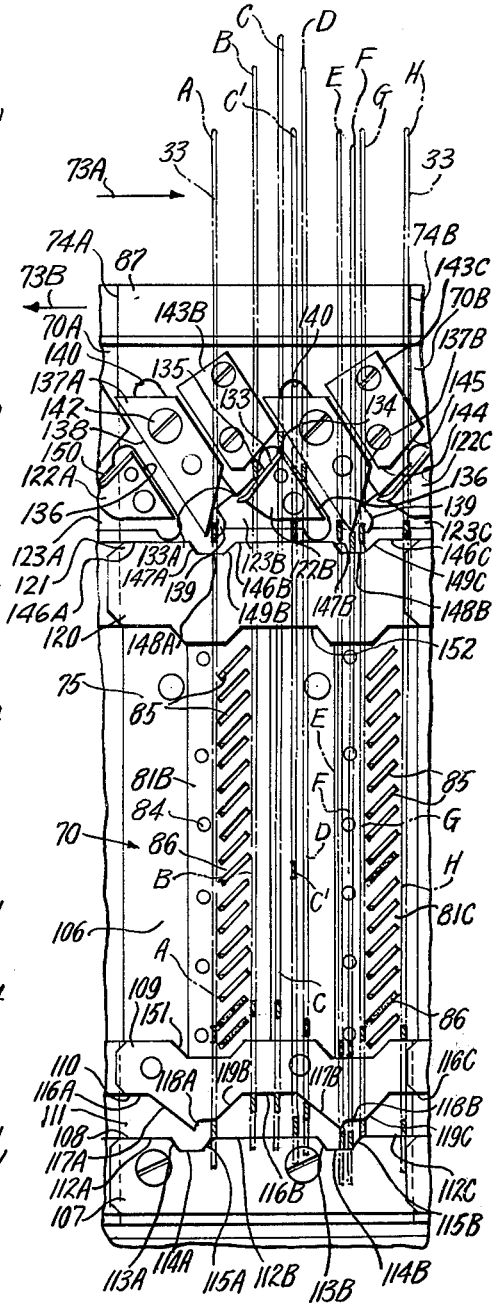
FIG. 4 is a fragmentary vertical section taken along the line 4—4 of FIG. 2, showing in elevation the inner face of a complete cam section and fragments of adjacent sections and showing in phantom the movement of a needle-jack pair across the section.

In the illustrated embodiment, selectors have been omitted from the fifteenth, sixteenth and seventeenth sites of insert 81B and 82B of FIGS. 1 and 4 merely to show that they can be omitted and to show the appearance of the structure without selectors. In insert 81B of these figures, the first and second selectors are in the operative position and the remaining are in the inoperative position. In insert 81B of these figures, the first and second selectors are in the operative position and the remaining are in the inoperative position. In insert 81c of these figures, the second and eighth selectors are in the operative position and the remaining ones are in the inoperative position. In FIG. 2, the only selectors shown are the first and second in the operative position and the eighth in the inoperative position, the rest being omitted for purposes of clarity. In each figure, the inner or outer edges of the selectors in the operative position are stippled.

To the inner face of cam support 75 there is secured a first jack cam element 107 whose forward surface defines a forwardly directed jack welt control cam track 108. A second jack cam element 109 is secured to the inner face of the cam support 75 longitudinally spaced apart from the first jack cam element, said second cam element 109 having a rearwardly directed surface defining a rearwardly directed jack return control cam track 110. Cam tracks 108 and 110 are opposed so as to define a jack control raceway 111 for receiving jack control butts 53. Jack welt control cam track 108 is defined by lateral dwell surfaces 112A, 112B, and 112C; rearwardly inclined cover surfaces 113A and 113B; lateral dwell surfaces 114A and 114B; and forwardly inclined welt camming surfaces 115A and 115B. Jack return control cam track 110 is defined by lateral cover and dwell surfaces 116A, 116B and 116C; rearwardly inclined return cam surfaces 117A and 117B; forwardly inclined cover surfaces 118A and 118B inclined at a small angle; and forwardly inclined cover surfaces 119B and 119C at a greater angle.

The precise function of each of the surfaces of cam tracks 108 and 110 will be later described in detail. Briefly, each camming surface 115A and 115B of cam track 108 provides the first camming forces for cooperating with jack control butt 53 to move a jack forwardly sufficiently to move its corresponding needle from cast off to welt (from the position in FIG. 7 to the position in FIG. 5). Therefore, cam track 108 can be called a jack welt control track. Each camming surface 117A and 117B of cam track 110 provides the fifth camming forces for cooperating with jack control butt 53 for returning the jack to its rearmost position either from its forward position wherein the corresponding needle was brought to tuck, or from its forward position wherein the needle was at welt. Therefore track 110 can be called a jack return control track. The jack control raceway, therefore, defines jack welt control cam means for cooperating with a jack control butt to move the jack forwardly sufficiently to move its corresponding needle from cast off to welt and jack return control cam means for cooperating with a jack control butt to move the jack rearwardly from its forward position to its rearward position. It is also apparent that the invention provides jack cam means for cooperating with jacks for moving jacks forwardly a sufficient distance to move the corresponding needles forwardly at least a portion of the forward movement of the movement cycle of the needles, the jack control cam means moving the jack part way and the pattern cam means moving the jack part way in the illustrated embodiment.

A reserve or standby cam element 120 is secured to the inner face of cam support 75 forwardly from the foremost slot 85, said third cam element having a forwardly directed surface defining a forwardly directed cam track 121 having a purpose which will be later described.

Forwardly of third cam element 120 there is a spring biased latch clearing cam 122B (see FIGS. 2, 4 and 16) substantially triangular in shape and the cam support 75 is provided with a cam receiving recess 123B outwardly of clearing cam 122B, said recess extending transversely from the inner face of the cam support only part way through the cam support, and terminating at recess bottom 124 and having a shape for receiving clearing cam 122B. A guide stud 125 extends inwardly into the recess from bottom 124 to about the inner face of the cam support, and is received within guide bore 126 in clearing cam 122B.

A bore 127 extends transversely through the cam support 75, constantly bottom 124 through the outer surface of the cam support, said bore being of reduced diameter adjacent said outer surface to provide a shoulder forming a spring seat 128. A bolt 130 passes through bore 127, the inner end of the bolt being threaded into the outer side of clearing cam 122B, the diameter of the bolt being reduced outwardly of the outer side of the cam to provide another spring seat 128A. A compression coil spring 129 surrounds bolt 130 in bore 127, the outer end of the spring being seated against spring seat 128 with the inner end thereof being seated against spring seat 128A to constaantly urge the bolt and therefore the cam away from bottom 124. A nut 132 is threaded onto the outer end 131 of the bolt which projects outwardly from the cam support.

When the cam 122B is to be in the operative position with its inner face projecting out of the recess, nut 132 is screwed onto the bolt a sufficient distance to prevent the spring from moving the cam further inwardly past the operative position. When in the operative position the cam 122B can be depressed into the recess against the resilient force of the spring. When the cam 122B is to be maintained in the inoperative position wherein its inner face is substantially flush with the inner face of the cam support, nut 132 is further screwed onto the bolt, to thereby retract the bolt and to retract the cam into the recess. In FIG. 2 clearing cam 122B is shown in the operative position in solid lines and in the inoperative position in phantom.

Very frequently a particular cam element of a cam section is mounted on that cam section but projects laterally beyond the longitudinal margin of that cam section so that it overhangs or overlies the adjacent cam section. Cam section 70, in the illustrated embodiment, is provided by another spring biased latch clearing cam 122A which so overhangs the preceding cam section 70A. In order to permit overhanging cam 122A to be moved outwardly to the inoperative position the adjacent cam sections 70A and 70 are jointly provided with a recess 123A comparable to recess 123B, the leading part of recess 123A being formed in the cam support of preceding cam section 70A with the remainder of the recess being formed in cam support 75 of cam section 70. The remaining structure mounting clearing cam 122A, namely, guide stud, spring, bolt, bore for spring and bolt, etc., are mounted or formed on that portion of recess 123A which is formed in the cam support 75 of cam section 70. A similar construction is provided for clearing cam 12²C which is physically secured to subsequent cam section 70B but overhangs or overlies the trailing margin of cam section 70. Recess 123C for receiving clearing cam 122C is divided between cam section 70 and cam section 70B.

The inner face of each clearing cam 122A, 122B and 122C (see FIG. 16) is milled down so as to leave at the inclined leading side of the cam an inwardly projecting oblique border 133 which extends from the apex 134 of the cam and terminates in an outwardly inclined or beveled tip or lip 133A, and extends inwardly from cam face 134A. The free end 133B of the tip projects laterally out of the plane defined by the leading surface of the projecting border 133 a very small distance toward the preceding cam section. The inner face 133C of the bevel is inclined from its leading side inwardly and laterally toward the trailing side of the cam to provide, in effect, a camming face inclined relative to the inner face of the clearing cam. The inclined surface of the leading side (including the border 133) of the clearing cam from apex 134 to the beginning of lip 133A defines a forwardly directed camming surface 135. The inclined surface of the trailing side of the clearing cam defines a forwardly directed cover surface 136, for guiding butts being rearwardly cammed by camming surface 138 of stitch cam 137A or 137B.

Cam surface 135 of the clearing cam, when in the operative position, provides the third camming forces for acting on needle butts 57 for moving the needles forwardly from the tuck position to the clearing position. The application of third camming forces is optional since in one or more courses it may be desired not to project needles forwardly past the tuck position so that such needles tuck. When the third camming forces are not to be applied to clearing cam is retracted into its recess to the inoperative position or, alternatively, the clearing cam is removed.

Occasionally a needle which is supposed to remain at the welt position will move forwardly to a misaligned position intermediate the welt and the tuck position. The relative movement of the cam portion and the needle bed will cause the side of the butt 57 of such a needle to strike the leading edge of camming surface 135 to cause damage to the needles and/or cams. However, by providing the construction of lip 133A, any butt 57 raised to such a misaligned position will instead coact with inner or camming face 133C to urge the clearing cam outwardly against the action of spring 129 to render the clearing cam inoperative and prevent damage. When such butt passess projecting border 133, the spring 129 will urge the clearing cam partially inwardly, while that butt continues to pass across the milled inner face 134A of the clearing cam until that butt passes the clearing cam, at which time the clearing cam is urged by spring 129 further inwardly to its normal position. As soon as that butt passes border 133 the clearing cam becomes sufficiently operative to coact with needles following the misaligned needle so that the machine can continue its proper operation.

Adjustable stitch cams 137A and 137B, trapezoidal in shape, each have at their leading side a rearwardly directed camming surface 138 at an angle with the horizontal about the same as the angle of the opposed cover surface 136 of clearing cam elements 122A and 122B, respectively. Each stitch cam is mounted on a stitch cam carrier or slide 139 which is slidably mounted in an oblique recess 140 in the cam support 75 immediately outwardly of the corresponding stitch cam, recess 140 being at the same angle as cumming surface 138 to permit the carrier to be moved forwardly-rearwardly in the recess while the angle of cam surface 138 remains constant. An oblique slotted bore 141 communicating with the bottom of the recess and the rear of the cam support has a bolt 142 passing therethrough in threaded engagement with a carrier. The bore 141 is at the same angle as camming surface 138 to permit the forward-rearward movement of the stitch cam carrier in recess 140. Tightening bolt 142 fixes the carrier, and therefore the stitch cam, in its appropriate position, depending upon the length of the stitch to be drawn. The maximum length stitch is drawn when the stitch cam is in its rearmost position. Moving the cam forwardly shortens the length of the stitch.

Each camming surface 138 provides the fourth camming forces for cooperating with the needle butt 57 to move the needle rearwardly from its forward position to the cast off position. Camming surface 138 cooperates in this manner with the needle butt whether the needle has been brought to the clearing position, or whether the needle has been brought only to the tuck position, or whether the needle is at the welt position, or whether the needle is intermediate of welt and tuck (inadvertent), the forward position of the needle therefore being the respective forward position of the needle during that course.

On each cam support 75 there are mounted cover cams 143B and 143C, each having a rearwardly directed first cover surface 144 and a rearwardly directed second cover surface 145. Cover cam 143B is mounted forwardly of clearing cam 122B and cover cam 143C is mounted forwardly of clearing cam 122C. Each cover surface 144 cooperates with the needle butt 57 to limit forward movement thereof when the needle is moved to the tuck position by a pattern cam element or selector 86 acting on its corresponding jack 34 and second cover surface 145 controls forward movement of the needle butt 57 as the needle butt 57 is being moved by the camming surface 135 of the clearing cam from the tuck to the clearing position.

Standby cam track 121, which has no essential function during the normal knitting operation, is defined by lateral dwell surfaces 146A, 146B and 146C; rearwardly inclined cover surfaces 147A and 147B; lateral dwell surfaces 148A and 148B; and forwardly inclinded camming surfaces 149B and 149C. Lateral dwell surfaces 146A, 146B and 146C dwell the needle butt at the welt position. Lateral surfaces 148A and 148B represent the maximum limit for drawing a stitch. If the stitch cam is not set to its maximum position, the rear edge of the needle butt will not extend rearwardly to these surfaces. Surfaces 149B and 149C are camming surfaces but in the normal operation of the machine they serve no function. Their only purposes is to be available, on a standby basis, in the event the respective camming surface 115A or 115B of jack welt control cam track 108 fails to move a jack sufficiently to move its corresponding needle forwardly to the welt position, because of a broken jack butt or some other accident. In such an event the needle butt 57 will coact with camming surface 149B or 149C and the needle will be raised from the cast off to the welt position and thereby prevent damage to the needles. To be effective on a standby basis, camming surfaces 149B and 149C must trail camming surfaces 115A and 115B respectively. The height of standby camming surfaces 149B and 149C is greater than that of surfaces 115A and 115B because the former does not utilize the multiplier, since they act directly on the needle butt.

The structure which has just be described for acting on needle butts, namely, clearing cams, stitch cams, and cover cams, define a needle butt raceway 150 for receiving needle butts. The invention therefore provides needle cam means for cooperating with needle butts, independently of the jacks, for optionally moving the needles from the tuck position forwardly to the clearing position and then for moving needles rearwardly from their respective forward positions to the cast off position. The respective forward position of a needle may be the clearing position, or the tuck position, or a position intermediate the tuck and welt, or the welt position, depending upon the particular movement cycle of that needle. In other words, the needle cam means cooperates with the needle butt means on each needle for continuing the forward movement of the needle, if any is needed for the movement cycle of the needle, as well as for then returning the needle to the cast off position from its forward position.

The forward surface of cam element 109 and the rear surface of cam element 120 which appear to be shaped as cam tracks are not cam tracks. The cutouts 151 and 152, respectively, on these surfaces are there merely to provide clearance for pattern butts at the rearmost and foremost pattern butt sites, respectively. Cam element 120 is particularly made to extend rearwardly as much as possible from its forward surface in order to cover as much as possible of the opening of access channel 17 (see FIG. 2). The inner surface of cam element 120 is opposed to the outer surface of wing 51 of jack 33 so that the inner surface of cam element 120 can act as a cover surface for wing 51 to help keep the jack in its groove when the camming forces applied to the jack tend to swing the jack out of its groove.

The preceding discussion has covered all the necessary structure of the invention. There will now be discussed the relationship and cooperation of the described structure in the actual knitting process, with particular reference to FIGS. 3 and 4. In the following discussion the knitting cycle will be considered as beginning and ending with the needle at the welt position and the discussion will be confined to one designated or chosen cam portion for knitting such a cycle.

This chosen cam portion is the one constituted by surfaces 112B, 113B, 114B and 115B of cam track 108; surfaces 119B, 116B, 117B and 118B of cam track 110; surfaces 146B, 147B, 148B and 149B of standby cam track 121; U-shaped insert 81B, the pattern cam sites and selectors thereon, only the selectors in the first and second positions being in the operative position; clearing cam 122B and the surfaces thereof; stitch cam 137B and the surfaces thereof; and cover cam 143B and the surfaces thereof. The surfaces of cam tracks 108, 110 and 121 which have the same numerals as the surfaces of the chosen cam portion but with the suffix "A" are identical in function to those of the chosen cam portion but are part of the preceding cam portion, while those surfaces the suffix "C" are part of the succeeding cam portion. Similarly, clearing cam 122A and stitch cam 137A are part of the preceding cam portion and clearing cam 122C and cover cam 143C are part of the succeeding cam portion.

This discussion will be directed to jacks 34 having a control butt 53, one pattern butt 54 and needles 33 corresponding thereto having a needle butt 57. Some of these jacks have the pattern butt at the first pattern butt site and others have a pattern butt at the eighth pattern butt site. FIG. 4 shows the needles and jacks in phantom with the various positions of the needles and jacks being indicated by the reference letters A through H. FIG. 4 can be construed in two ways. It either can be considered as showing the position of a particular needle-jack pair as such pair moves across the cam portion, or it can be construed as showing the simultaneous appearance of needle-jack pairs at positions A through H. FIG. 4 also shows one needle-jack pair at position C′, the jack of this pair having a pattern butt at the eighth site while positions A through H relate to needle-jack pairs wherein the jack has a pattern butt at the first site. Positions A through G cover one knitting cycle or the chosen cam portion.

FIG. 3 shows a portion of the needle bed immediately underlying the chosen cam portion and a fragment of the succeeding cam portion. In alternate grooves of the needle bed there are positioned needle-jack pairs wherein the jacks have a pattern butt at the first pattern butt site, while in the intervening grooves there are positioned needle-jack pairs wherein the jacks have a pattern butt at the eighth pattern butt site. Positions A through H show the pairs wherein the jack has the pattern butt at the first site and positions A′ through G′ show the pairs wherein the jack has the pattern butt at the eighth site. In order to accommodate the primed positions the horizontal scale of FIG. 3 between the respective positions has been distorted.

The beginning of the chosen cam portion, and therefore the beginning of the knitting cycle to be discussed, is represented by a needle-jack pair at position A. In this position the jack and the needle are as shown in FIG. 5, the welt position. The rear edge of jack control butt 53 is on the leading end of dwell surface 112B and pattern butt 54 is aligned with the entranceway between the first and second selectors 86. The rear edge of needle butt 57 is spaced forwardly from surface 148A and is horizontally aligned with surface 146B. As the needle jack pair moves in the direction of arrow 73A relative to the cam portion, from position A to position B, camming surface 104 of the first selector will act on the rear edge of pattern butt 54 to provide the second camming forces to move the jack forwardly. During this forward movement surface 119B acts as a cover surface for the forward edge of jack 53, the jack completing its forward movement with the forward edge of the butt 53 at the leading end of dwell surface 116B. During this movement the jack moves rocker 35 to move the needle forwardly, with surface 144 of cover cam 143B acting as a cover for the needle butt, so that in position B needle butt 57 is aligned with the leading end of the camming surface 135 of clearing cam 122B. The needle and jack are now in the tuck position, as shown in FIG. 6.

with the clearing cam 122B being in the operative position, further movement of the needle-jack pair relative to the cam portion moves the pair to position C. During the movement to position C jack butt 53 dwells on surface 116B while needle butt 57 is cammed forwardly by cam surface 135 of clearing cam 122B, under cover of cover surface 145 of cover cam 143B, until the needle butt reaches the apex 134 of the clearing cam, at which position the needle is now at the clearing position, as shown in FIG. 2. The coaction between cam surface 135 and the needle butt provides the third camming forces.

If the jack of the needle-jack pair did not have pattern butt 54 at the first position, the first selector would not have coacted with that jack so that as the needle-jack pair moved from position A toward the position corresponding to position C, jack butt 53 of that pair would dwell on dwell surface 112B and the needle butt 57 would dwell at the welt position on dwell surface 146B and not be moved through a knitting cycle by the chosen cam portion. The position of such a non-knitting needle-jack pair is shown at C′.

As the needle-jack pair moves further along the cam portion from position C to position D, the needle butt 57 is acted on by camming surface 138 of stitch cam 137B to cam the needle butt rearwardly, under cover of cover surface 136 of clearing cam 122B. After camming surface 138 has started moving the needle rearwardly, camming surface 117B starts acting on control butt 53 of the jack to move the jack rearwardly. In the position shown at D, the needle butt 57 is laterally aligned with the position it was in in position B (the tuck position). If clearing cam 122B of the chosen cam portion were in the inoperative position, the camming surface 135 of the clearing cam would not have moved the needle forwardly from the tuck position to the clearing position so that the needle would have remained at the tuck position. Further movement of such a needle-jack pair along the cam portion would keep the needle at the tuck position until the needle arrived at position D where it would be then available to be cammed rearwardly by the camming surface 138 of stitch cam 137B.

As the needle-jack pair moves from position D to position E, whether the needle previously advanced to the clearing position or only advanced to the tuck position, camming surface 138 of stitch cam 137B moves the needle further rearwardly to the welt position. At the same time, camming surface 117B moves butt 53 to its rearward position at dwell surface 114B. It is noted, therefore, that at position E the jack has returned to the rearward position but the needle has not yet returned to its rearward position.

As the non-knitting needle-jack pair moves from the position shown in C′ to the position corresponding to position E, its needle would be at the position identical to that shown in position E, so that needle butt 57 would be available for further rearward camming by camming surface 138 of stitch cam 137B. The butt 53 of the jack of that pair as it approached the position corresponding to position E would strike camming surface 117B near its trailing end and thereby move that jack rearwardly to the position shown at position E.

As the needle-jack pair moves from position E to position F, camming surface 138 of stitch cam 137B rearwardly cams the needle butt to move the needle to the cast off position while jack butt 53 dwells on dwell surface 114B. The needle and jack are now in the position shown in FIG. 7, the cast off position.

Camming surface 138 of stitch cam 137B provides the fourth camming forces to move each needle from its forward position to its cast off position, whether the forward position be the clearing position, or the welt position, or any intermediate position. Camming surface 117B provides the fifth or return camming forces to return the jack to its rearward position from its forward position, whether the forward position is that wherein the jack is at maximum possible forward position or at any position rearwardly thereof.

As the needle-jack pair moves from position F to position G, jack butt 53 is cammed forwardly by cam surface 115B under cover of cover surface 118B, until the butt is at the leading end of dwell surface 116C of the following cam portion. The forward movement of the jack pivots rocker 35 forwardly and the rocker in turn moves the needle forwardly from the cast off position to the welt position (FIG. 5) so that position G represents the end of the cycle and the needle and the jack of the pair are in the same position they were in at the beginning of the cycle, position A. Position G represents the final position of the chosen cam portion and the initial position of the succeeding cam portion. Camming surface 115B provides the first camming forces to move the jack and needle forwardly to the welt position.

The needle-jack pair at position G knitted during the chosen cam portion because of the correspondence between the operative selector at the first pattern cam site and the jack butt 54 at the first pattern butt site. However, the jack of this pair does not have a pattern butt at a site corresponding to any pattern cam site at which there is a selector in the operative position in the following cam portion. Therefore, as this needle-jack pair moves from position G to position H, the needle and jack remain at the welt position (FIG. 5).

Referring to FIG. 3, positions A through H are the same as those described in connection with FIG. 4, and show the positions of the needle-jack pair wherein the jack has a pattern butt corresponding to a pattern selector in the operative site. The needle-jack pairs wherein the jack has a pattern butt at the eighth site and which are not moved through a knitting cycle by the chosen cam portion, are shown in the primed positions. This non-knitting pair is at the welt position in positions A′, B′, C′ and D′. Note that the primed positions lead the non-primed positions and therefore at position E′ the non-knitting needle-jack pair has been moved rearwardly to the cast off position. At position F′ this pair has been moved forwardly sufficiently to move the needle to the welt position (the position of FIG. 5) and therefore position F′ shows the beginning of the next cycle for this pair. At position G′ this needle-jack pair has been moved forwardly a short distance because the pattern butt on that jack at the eighth site has coacted with the selector at the eighth site in the cam portion following the chosen cam portion.

In the preceding discussion no reference was made to downwardly inclined surface 113B of track 108. This surface can be considered a cover surface for the control butt on the jack as it is being returned to its rearward position. However, in reality it is a transition surface between dwell surfaces 112B and 114B, since surface 114B must be disposed rearwardly of surface 112B. Surface 114 B is located sufficiently rearwardly to accommodate the maximum possible length stitch which can be drawn by the stitch cam.

EXAMPLE OF KNITTING A SPECIFIC PATTERN

An example will be set forth showing the knitting of a specific pattern with the machine of the invention. Beginning at any arbitrary point in the needle bank a needle and its corresponding jack are called No. 1. The next needle-jack pair is called No. 2 and the following needle-jack pairs are consecutively numbered in this manner. The jack corresponding to each needle is provided with only one pattern butt. The butt of jack No. 1 is at the 1st pattern butt site, the butt of jack No. 2 is at the 2nd pattern butt site, and so on until the butt of jack No. 17 is at the 17th pattern butt site. The butt of jack No. 18 is at the 16th site, with the site numbers decreasing successively for each succeeding jack so that jack No. 33 will have a butt at the 1st site. Jack N0. 34 then will have its butt at the 2nd site and so on in ascending order until jack No. 49 has its butt at the 17th site; then in decreasing order for the next 16 jacks until jack No. 65 (site No. 1); then in ascending order for the next 16 jacks, and so on.

The machine is provided with 64 feeds numbered consecutively from No. 1 to No. 64. The odd numbered feeds furnish white yarn and the even numbered feeds furnish black yarn. Feed No. 1 has the selector in the operative position at the 1st pattern cam site, the remaining selectors being in the inoperative position. Feed No. 2 has the selector in the 1st pattern cam site in the inoperative position with the remaining selectors being in the operative position, so that feed No. 2 is the reverse of feed No. 1. Feed No. 3 has an operative selector at the 2nd site, the remaining being inoperative, while feed No. 4 is the reverse of feed No. 3. Each even numbered feed is the reverse of the preceding odd numbered feed. The site of the operative selector in the odd numbered feeds ascend so that feed No. 5 would have the operative selector in the 3rd site, etc., up to feed No. 33, which will have the operative selector at the 17th site and feed No. 34 will be the reverse. The sites of the operative selectors in the odd numbered feeds then descend so that feed No. 35 will have the operative selector in the 16th site and feed No. 36 will be the reverse, etc.

When these feeds knit the arrangement of needles just described, the 1st feed will knit with white yarn needles No. 1, No. 33, No. 65, etc., while the 2nd feed will knit, with black yarn, all the needles except those which knitted with the first feed. Successsive feeds operate the needles in a similar manner. This arrangement will produce a fabric having a repeated white diamond pattern, in outline, against a black ground with each diamond being 32 courses in length and 32 wales in width.

GENERAL CONSIDERATIONS AND VARIATIONS

The preceding description has covered preferred embodiments of the invention. It is apparent that numerous changes, including additions and omissions, can be made without departing from the spirit or concept of the invention. Most of these variations will not be described in detail nor illustrated, since they are within the obvious skill of a worker in the art.

Obviously, the number of pattern cam sites and corresponding pattern butt sites can be varied, depending upon the versatility which it is desired to have in the machine. As previously described, the needles, as they are being moved rearwardly by the stitch cam, automatically return the jacks to the rearward position and therefore, obviously, the jack return cam track can be omitted. Nevertheless, it is desirable to include such a track to relieve the load on the stitch cam, needle butt, and needle. It is well known that when knitting certain patterns with certain yarns, the elasticity of the fabric acts to move the needles forwardly from the cast off position to about the welt position. However, this movement caused by the fabric is not necessarily precise and often leaves a line on the fabric. If the elasticity of the fabric is to be used for moving the needles from cast off to welt, then, obviously, the jack welt control cam track can be eliminated. However, it is preferred to use such a track at least to move the needles to the welt position from a position rearwardly thereof. When using the multiple patterning raceway of the invention the pattern jacks must be carefully aligned with the selectors and the use of the jack welt control track serves to carefully align the jacks.

In the preceding description some of the cam elements, such as elements 107 and 109, have sufficient camming for more than one cam portion while other elements, such as selectors 86 and clearing cam 122B, provide the necessary camming for only one cam portion. It is well known in the art that cams can be assembled from a plurality of pieces. To avoid any misconception, it is desirable to refer to each part of a cam track which performs a particular function for one cam portion as a cam segment, whether such cam segment be made up of a plurality of pieces or elemnts, or whether it is made up of only one piece or element, or whether it is only part of a larger element. Obviously, in this fashion each selector 86 is a pattern cam segment, each clearing cam 122A, 122B or 122C is a clearing cam segment, etc. In a similar manner, camming surfaces 115A and 115B which are parts of a single piece or element 107 can be considered as defining two segments, with surface 115A defining the jack welt control segment of the cam portion preceding the chosen cam portion, while camming surface 115B defines the jack welt cam segment of the chosen cam portion.

As is well known in the art, a cam section can comprise one or more cam portions. Each cam section can begin and end the camming at any desirable point in the knitting cycle, the selection being made according to conventional considerations as to where it would be more convenient to begin the cycle.

The invention comprehends two rather distinct aspects, the first being the movement multiplier for increasing the movement of the needle relative to the jack, and the second being the multiple patterning raceway for providing selectivity. Each of these aspects can be used without the other. If the multiplier or rocker is not used, the machine can still be provided with a needle bed identical with that disclosed but with the rockers being removed. Alternatively, a conventional needle bed can be used. The camming for such an arrangement could still utilize the multiple patterning raceway substantially as disclosed. However, without the multiplier it would be necessary to increase the height and width of the camming segments which move the jacks forwardly. With such a modification there would be no increase in the number of yarn feeds but it would still be possible to increase the number of effective raceways which can be used for patterning compared to conventional machines having plural complete raceways.

If the multiplier is used without the multiple patterning raceway, conventional camming can be used. This will still permit the use of cam portions of reduced width and thereby permit increased yarn feeds. It will also permit the use of reduced cam heights. For example, if no patterning is desired, the jack need only be provided with one butt and there need be only one jack butt raceway which will move the jack from its rearward position forwardly a sufficient distance to move the needle to tuck position. The needle butt raceway can be the same as disclosed. If patterning is desired, several conventional raceways can be used for the jack butts and the jack will have pattern butt sites corresponding to the raceways.

Figure 15:
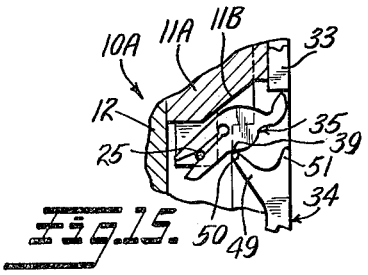
FIG. 15 is a fragmentary cross section of the needle bed of a modification permitting the jack and rocker to move the needle past the tucking position.

According to the disclosed embodiment, the jack cannot raise the needle past the tuck position because the rocker would abut the rear end of the forward body section 11 of the needle bed. If it is desired to use the multiplier to raise the needles forwardly of the tuck position, e.g., the clearing position, the needle bed needs to be slightly modified, and such a modification is shown in FIG. 15. In such a modification the needle bed 10A is modified by providing a circumferential or laterally extending cutout 11B at the rear end of forward body section 11A outwardly of the pintle to provide clearance for the forward edge of the rocker 35 when the jack is advanced forwardly of the position shown in FIG. 6. Obviously, in order to project the needles further forwardly by means of the jack and rocker, the height of cam surface 104 of the selectors 86 would have to be increased. If the selectors are of a sufficient height to cause the needles to be moved to the clearing position, the clearing cam can be omitted. In the event certain needles are to tuck in such a modification the height of the selectors which actuate the jacks of such needles would be the same as that illustrated.

In view of the above, it is apparent that the multiplier rocker can be used for all or any part of the projection cycle of the needle. Preferably, it is used for moving the jack sufficiently to move the corresponding needle from at least the welt position to at least the tuck position.

In the illustrated embodiment, the fifth or return camming forces provided by camming surfaces 117A and 117B always return the jack to a dwell surface 114A or 114B regardless of the length of the stitch drawn by the stitch cam and, as previously described, surfaces 114A and 114B are located sufficiently rearwardly to accommodate the maximum possible length stitch which can be drawn by the stitch cam. When the stitch cam is adjusted to draw a shorter stitch, the needle in the cast off position and the jack in its maximum rearward position on surface 114A or 114B are so spaced apart that rocker contacts 39 and 41 cannot simultaneously be abutting the respective jack contact 50 and needle contact 58. Obviously, the rocker can only transmit the jack movement to the needle when jack contact 50 is abutting rocker contact 39 at the same time rocker contact 41 is abutting needle contact 58. Therefore, as camming surface 115A or 115B starts moving th jack forwardly from its rearwardmost position the initial forward movement of the jack is not transmitted to the needle and the initial forward jack movement does not cause needle movement. Once the four contacts make their respective abutment, the further forward movement of the jack is multiplied and transmitted to the needle to move the needle forwardly a greater distance than the jack moved forwardly while its movement was being transmitted. Stated differently, during at least part of the jack forward movement, the jack is moved forwardly a predetermined distance during which time the four contacts are making their respective abutment to cause the corresponding needle to move forwardly a distance greater than the predetermined distance. The distance the needle moved depends on the degree of multiplication and the length of the predetermined distance the jack moved, that is, the longer the predetermined distance, the longer will be the distance the needle is moved.

It is apparent that all the actions of the multiplier rocker and the interaction of the jack, multiplier, and needle (the receipt of the movement from the jack, the multiplication of the movement, and the application or transmission of the multiplied movement to the needle) are effected or produced by the interaction of solid surfaces. Actions effected or produced by the interaction of solid surfaces, without the use of hydraulic or electric means are called "mechanical". The invention is directed to the use of mechanical movement multiplier means for mechanically receiving the forward jack movement and mechanically transmitting it to the needle while mechanically multiplying the length of the movement.

It is apparent that the invention comprehends the steps of moving each of at least some of the jacks forwardly at least a respective predetermined distance, mechanically converting the forward movement of the jack while it is moving said respective predetermined distance into a respective second forwardly directed movement whole length depends on and is longer than the respective predetermined distance the jack moved, and mechanically applying the respective second movement resulting from the moved jack to the needle corresponding thereto so as to move the needle forwardly a greater distance than the respective predetermined distance the jack is moved, the needle moving forwardly at least a portion of the forward movement of its movement cycle. It will be appreciated that the predetermined distance a jack moves may be different from the predetermined distance another jack moves. It is for this reason that the distances have been identified as "respective" predetermined distances, "respective" relating to the particular jack.

After the jack has moved its corresponding needle forwardly, according to the pattern being knit, the needle cam means further moves each needle forwardly, independently of the jack, through the remainder of the forward movement, if any, of the movement cycle of that needle. It will be appreciated that in some instances the needle is moved forwardly only by means of the jack, as it is in the illustrated embodiment where the needles only tuck and do not clear. In other words, in some movement cycles there is no further forward movement of the needles. It is also emphasized that reference to "further forward movement" means the remainder of the projection cycle immediately following the point where the needle was brought by the jack and up to the clearing position. It does not refer to movement after the stitch has been drawn. The needle cam means, e.g., the stitch cam, returns each needle to the cast off position from whatever forward position to which the needle was advanced during its movement cycle.

It will also be appreciated that in the illustrated embodiment a cam portion can move all needles to the clearing position, or can move selected needles to the clearing position with the remainder staying at the welt position, or can move all needles to the tucking position, or can move some needles to the tucking position with the remainder staying at the welt position. In the illustrated embodiment the cam portion cannot tuck some needles and clear others.

However, according to another embodiment of the invention (see FIG.17), a tucking cam segment can be provided in order to enable some needles to be moved to clearing while other needles are only moved to the tuck position. In each cam portion wherein it is desired to have such a tucking cam segment, cam element 120 is replaced by cam element 120' whose forward surface defines forwardly directed cam track 121' having a tucking cam segment 153 whose leading side defines the tucking camming surface 154 beginning at the trailing end of standby camming surface 149B'. The trailing side of tucking cam segment 153 defines a forwardly directed inclined cover surface 155. It is noted that tucking cam segment 153 is positioned inwardly of the inner face 134A' of a clearing cam such as clearing cam 122B'. In order to accommodate the tucking cam segment the inner face of clearing cam 122B' is milled down further than was the corresponding clearing cam 122B. The slightly modified clearing cam has a clearing camming surface 135' at its leading side and inclined surface 136' on the trailing side, which, because the decreased thickness of the clearing cam, no longer acts as a cover surface for camming surface 138 of stitch cam 137B.

The leading end of tucking camming surface 154 trails the leading ends of the camming surfaces 104 provided by the selectors 86. Therefore, during relative movement of the cam portion, any jack which has a pattern butt at a site corresponding to a pattern cam site having an operative selector will move its corresponding needle to the tucking position where the needle butt will be acted on by camming surface 135' of the clearing cam. Those jacks not having a pattern butt at a site corresponding to an operative selector will remain at the welt position but their needle butts 57 will then be acted on by tucking camming surface 154 to raise them to the tucking position while the clearing cam is raising the other needles to clearing. The needles tucked by the tucking cam and the needles cleared by the clearing cam will be moved rearwardly by the camming surface 138 of stitch cam 137B under cover of cover surface 155. It will be apparent that a cam portion having such a tucking cam segment will tuck some needles and clear others with no needles remaining at welt.

Since tucking cam surface 154 raises the needles from welt to tuck without using the multiplier, it is apparent that the height and width of this surface must be greater than camming surface 104 of the selectors 86. Nevertheless, there is sufficient height and width available in the cam portion to accommodate this tucking cam surface because, as is apparent from FIG. 17, this surface is located in the same area as the clearing cam but does not have to have the same height as the clearing cam. The tucking cam segment can be included in a manner comparable to that illustrated in any cam portion where such a segment is desired. It is apparent, therefore, that the tucking cam segment may be optionally included in the cam portion for providing tucking cam forces which, when applied to a needle, move such needle independently of the jack corresponding to the needle from the welt position to the tuck position. The tucking cam segment cooperates with the needle butt during this movement and therefore the tucking cam segment can be considered part of the needle cam means.

Obviously, other standard means can be used with the machine to vary the patterning ability thereof and the invention comprehends such additions. For example, pattern wheels and similar devices can be used. If is is desired to provide the automatic changing of the camming during selected revolutions of the machine, the machine can be provided with pattern drum means and similar devices to effect automatic changing during the revolution of the machine. In the illustrated embodiment the cam portion has one needle butt raceway and one jack control butt raceway. Obviously, there can be more than one needle butt raceway and more than one control butt raceway to give additional flexibility. If the number of needle butt raceways or control butt raceways is increased, the number of butt sites on the needles and the number of control butt sites on the jacks would have to be comparably increased. Another conventional variation which can increase the selectivity is the use of high and low butts and high and low cam segments.

The cam assembly can comprise a plurality of the particular cam portions embodying the invention, as well as one or more special cam portions or special yarn feeds for performing special functions on special needles.

Normally, every needle groove in the needle bed during the knitting operation contains a knitting needle and in the instant case it would therefore contain a jack, a corresponding needle and the multiplier when used. However, as is well known, occasionally it is desired to knit a fabric having a lesser number of wales than the number of needle grooves. In such an event, needles are removed from selected grooves. This is done with the needle bed of the invention. Both the needle and jack can be removed from selected grooves, or just the jack alone, or just the needle. When using the particular cam portion described herein, such jacks without needles or needles without jacks, although they would go through a movement cycle, would not take part in the knitting of the pattern and therefore they are inoperative and for practical purposes are the equivalent of vacant grooves. Furthermore, one or more grooves may have therein the needle and jack but they are rendered inoperative during the knitting of a particular pattern by other conventional means. Such needle-jack pairs are also considered inoperative. In one or more selected grooves there may be a needle without a jack wherein the needle does go through a knitting cycle during the knitting of a particular fabric but such needle is not activated by the particular cam portions but is actuated by a special cam portion having conventional camming. Such a needle is then considered operative but is merely an added element outside of the present invention. This invention is directed to the use of operative needle-jack pairs, namely, pairs wherein both the needle and the jack have a function during the knitting of the fabric which the machine is set up to knit. A jack, of such an operative needle-jack pair, which is moved through a movement cycle whether or not its corresponding needle goes through a knitting cycle, by a particular cam portion is called an active jack relative to that particular cam portion. Stated differently, an active jack is the jack of an operative needle-jack pair which goes through the movement cycle during the knitting of a particular course. A pattern jack is an active jack having one or more pattern butts thereon and normally each active jack is a pattern jack. However, it is possible to have one or more active jacks which are not pattern jacks. Stated differently, a pattern jack is a jack capable of being acted on by the second camming forces.

A particular cam portion is a cam portion embodying the present invention, namely, a cam portion having one or more pattern cam sites at which a pattern cam segment 86 in the operative position could cooperate with a pattern butt on a corresponding jack butt site. Each jack of an operative needle-jack pair which is moved by that particular cam portion is an active jack. An operative particular cam portion is one which has at least one pattern cam segment in the operative position for cooperating with pattern butts on at least some pattern jacks during the knitting of the fabric which the machine is set up to knit. A particular cam portion is considered inoperative if it has no pattern cam segments in the operative position or if all the pattern cam segments thereof in the operative position are at sites which do not correspond with pattern butt sites having butts thereon. Such cam portions are considered inoperative cam portions because they would not raise any needles to the tuck position by means of a pattern cam segment. The effect of such an inoperative cam portion is equivalent to a blank in the cam assembly, since it serves no knitting function. A cam portion having no operative selectors, but having a tucking cam segment, will bring the needle to the tuck position, but nevertheless is not considered an operative particular cam portion, since the pattern cam segments are not utilized.

A particular course is a course equivalent to that knit by an operative particular cam portion. In other words, a particular course is one in which needles are brought to the tuck position by means of the second camming forces and in which the first camming forces are applied to each active jack to move its corresponding needle to the welt position after it has been brought back to the cast off position.

In view of the foregoing, it will be appreciated that a cam assembly having a plurality of operative particular cam portions may also have one or more inoperative particular cam portions and may also have one or more special cam portions (cam portions not encompassing the novel camming of the invention).

A pattern jack may have one or more pattern butts thereon and each particular cam portion may have one or more selectors in the operative position. The arrangement of the needle-jack pairs in the needle bed or bank, the arrangement of the pattern butts at appropriate sites, and the selection of the operative pattern cam segments depends, of course, on the pattern to be knit by the machine and such selection is well understood by a worker in the art. It is pointed out that if each pattern jack has a butt at the first site, as well as butts at one or more other sites, a cam portion having a selector in the operative position at the first site would cooperate with all the pattern jacks for that course. The other butts and other selectors would cooperate in other courses. Alternatively, if it is desired for a particular course to move all the needles to at least the welt position, all the pattern cam segments can be placed in the operative position so that all pattern jacks will be actuated.

The diameter of the cylinder of a cylinder machine is the diameter of a circle defined by the bottoms of the needle grooves, while the circumference of the cam assembly is measured at about the mid point of the depth of the cam elements. A 30 inch cylinder machine can therefore accommodate a cam assembly about 96 inches in circumference and such assembly can have 96 cam portions or yarn feeds if the width of each cam portion is about one inch. In the illustrated embodiment the needles reciprocate about 11/16 inch in the knitting cycle with the major part (cast off to tuck) of the needle movement during the projection cycle being effected by the jacks and multipliers. A 30 inch cylinder machine cannot accommodate 96 conventional cam portions for such a needle reciprocation distance. Because of the multipliers, the width of the part of the cam portion for effecting this major part of the projection cycle equals about 40% of the distance the needle is projected from cast off to tuck and the width of the part of the cam portion for effecting the total projection cycle is about 50% of the total needle projection distance. This renders it possible to have a cam portion whose total width is just about one inch and 96 cam portions can be accommodated in the cylinder cam assembly of a 30 inch cylinder machine.

By constructing the pattern cam segments in the illustrated manner, that is, fashioning them from relatively thin plates of metal, the trailing surface 105 of the selector 86 is substantially parallel to the camming surface 104 of the selector and the distance therebetween is minimal. This construction permits adjacent "raceways" of the multiple patterning raceway to, in effect, overlapso that the butt of a jack being raised by one selector can extend forwardly into some of the space occupied by the selector forwardly thereof. This permits economy of height in the multiple patterning raceway.

In the foregoing description only an incidental mention has been made of the dial. As has been indicated, the invention can be used with single needle bed machines such as a cylinder machine and the patterning effect can be used to knit jersey fabric. If the machine is a cylinder and dial machine, one needle bed need only be used if a jersey fabric is desired. If the cylinder and dial machine is to be operated to knit rib or double knit fabrics, both cylinder and dial will have to be used. In such a case both the cylinder and dial can utilize the present invention. In most instances, double knit fabrics would not require that the dial have a needle bed or camming according to the present invention, because patterning flexibility is not necessary for the dial and it is therefore possible to use a conventional dial with known camming arrangements such as, for example, that shown in U.S. Pat. No. 3,026,695.

The flexibility of patterning becomes particularly important when it is desired to have at least three patterning sites. If only one or two, and perhaps three, patterning sites are desired, conventional plural raceway camming with complete raceways can be conveniently accommodated in a reasonable cam section height. If the number of conventional raceways were to be increased beyond three, the height of the cam section would become unreasonable.

In the illustrated embodiment the camming forces applied to the jacks and needles are applied directly thereto by means of their respective butts. Obviously, camming forces can be applied thereto directly or indirectly.

Although the illustrated embodiment involves the use of jacks, it is apparent that a cam portion having the multiple paterning raceway construction of the invention has a degree of utility with machines not using jacks. The needles themselves could have plural butt sites for cooperating with the selectors. In other words, the pattern cam segments can cooperate with needle butt means or jack butt means for moving needles at least a portion of their projection cycle.

It is emphasized that the maximum advantages of the invention can be obtained when there are used both the multiplier and the particular camming of the invention. When using the total invention it is possible to make a machine having many more yarn feeds than comparable prior art machines and at the same time provide sufficient patterning versatility to produce jacquard patterns. Whereas the present invention permits the manufacture of machines having 96 feeds, the prior art has resulted only in the production of machines for jacquard patterning havong only 48 feeds, although the prior art has been able to make 72-feed machines when using pattern wheels to obtain the jacquard pattern. The invention permits distribution of the pattern over many more courses during a single revolution of the machine and also provides for distribution of the pattern over more wales without the use of complicated automatic devices. Although in the specific example 64 feeds were used, it should be borne in mind that this was merely an example and does not indicate the limits of the invention.

I claim:

1. In a multifeed knitting machine, a needle bed having a plurality of laterally spaced apart longitudinally extending needle grooves, each of at least some of said grooves having positioned therein an arrangement comprising a jack, a knitting needle corresponding thereto, and a movement multiplier rocker between said jack and needle for transmitting the movement of said jack to said needle while multiplying the length thereof, a. said jack being slidably mounted in said groove for forward-rearward reciprocation and having adjacent its forward end inwardly extending means defining a forwardly facing jack contact for abutting said rocker to transmit the movement of said jack to said rocker, b. said needle being slidably mounted in said groove forwardly of said jack for forward-rearward reciprocation and having outwardly extending butt means thereon, c. rearwardly facing needle contact means for abutment by said rocker to receive the movement of said rocker and to transmit said rocker movement to said needle, d. said rocker having an inner portion, an outer portion and an intermediate portion therebetween, e. said intermediate portion of said rocker having at the rear thereof a rearwardly facing first rocker contact for abutment by said jack contact to receive the movement of said jack, f. said outer portion of said rocker having a forwardly facing second rocker contact for abutting said needle contact means to transmit movement of said forward portion of said rocker to said needle, g. means pivotally mounting said inner portion in said needle bed about a pivot axis inwardly of said first rocker contact so that said first and second rocker contacts can oscillate forwardly-rearwardly about said pivot axis, h. whereby when said jack is moved forwardly said jack contact abuts said first rocker contact to pivot said rocker forwardly to cause said second rocker contact to abut said needle contact means and urge said needle forwardly a greater distance than said jack was moved forwardly.

2. A combination according to claim 1, wherein said intermediate portion of said rocker has a rear convexly curved surface, said surface defining said first rocker contact.

3. A combination according to claim 2, wherein said outer portion of said rocker is constituted by a neck extending outwardly from said intermediate portion, said neck terminating in a forwardly directed free end whose forward edge defines said second rocker contact, the rear surface of said neck being convex.

4. A combination according to claim 3, wherein said inwardly extending means on said jack is an inwardly and forwardly extending wing terminating in a forwardly directed free end whose forward edge defines said jack contact, said wing defining a recess at the forward end of said jack outwardly of said contact, said recess receiving said neck of said rocker when said jack and said rocker are in the rearward position.

5. A combination according to claim 4, wherein said inner portion of said rocker has a keyway extending laterally therethrough, said keyway extending from an inner edge of said inner portion outwardly to provide said inner portion with opposed inwardly extending arms, said keyway having an enlargement intermediate its ends, said enlargement defining a bearing for receiving pintle means, and wherein pintle means is mounted in said needle bed inwardly of said needle and jack and extending laterally at least part way across said groove, said rocker being removably inserted into said needle bed by passing said keyway about said pintle means until said pintle means is received within said bearing, said pintle means having a diameter less than the diameter of said bearing but greater than the width of the keyway at least immediately inward of said bearing, whereby said rocker is removably snapped onto said pintle means and pivotable thereabout.

6. A combination according to claim 1 and including a cam assembly and means for causing relative lateral movement between said needle bed and said cam assembly to operate at least some of said jacks and their corresponding needles, said cam assembly comprising jack cam means for cooperating with each of at least some of said jacks for moving said jack forwardly a sufficient distance to move its corresponding needle forwardly at least a portion of the forward movement of the movement cycle of said needle.

7. A combination according to claim 6, wherein said cam assembly also comprises needle cam means for cooperating with said butt means on each of said moved needles for continuing said forward movement of said moved needle, if needed for the movement cycle of said needle, and for subsequently moving each of said moved needles from its forward position rearwardly through the rearward portion of its movement cycle to bring it to the cast off position.

8. A combination according to claim 7, wherein said jack cam means cooperates with at least some of said jacks for moving them forwardly a sufficient distance to move their corresponding needles forwardly from at least the welt position to at least about the tuck position.

9. A combination according to claim 7, wherein, after said needle cam means moves said moved needles to the cast off position, said jack cam means cooperates with said moved jacks for moving them forwardly a sufficient distance to move their corresponding needles forwardly from rearward of the welt position to the welt position.

10. A combination according to claim 9, wherein said jack cam means comprises pattern cam means and control cam means, and wherein at least some of said jacks are active jacks for being moved by said control cam means, each of said active jacks having at least one outwardly extending control butt, at least some of said active jacks being pattern jacks having at least one outwardly extending pattern butt longitudinally spaced apart from said control butt; said pattern cam means cooperating with pattern butts on at least some of said pattern jacks for moving said jacks a distance sufficient to move their corresponding needles from the welt position to at least about the tuck position; said needle cam means moving each needle corresponding to an active jack rearwardly from its respective forward position to the cast off position; said control cam means cooperating with said control butts on all of said active jacks for moving them forwardly a sufficient distance to move their corresponding needles forwardly from rearward of the welt position to the welt position.

11. A combination according to claim 10, wherein said pattern cam means cooperates with said pattern butts for moving said jacks moved thereby forwardly only a sufficient distance to move their corresponding needles from the welt position to the tuck position.

12. A combination according to claim 11, wherein said control cam means cooperates with said control butts for moving said active jacks forwardly a sufficient distance to move their corresponding needles forwardly from the cast off position to the welt position.

13. A combination according to claim 12, wherein said needle cam means cooperates with said butt means on each needle moved to the tuck position by its corresponding jack for moving each needle further forwardly from the tuck position to the clearing position and then from the clearing position rearwardly to the cast off position, and wherein said needle cam means cooperates with said butt means on each needle, if any, not moved to the tuck position by its corresponding jack for moving such needle from the welt position rearwardly to the cast off position.

14. A combination according to claim 12, wherein said needle cam means cooperates with said butt means on each needle moved to the tuck position by its correponding jack for moving each needle from the tuck position rearwardly to the cast off position, and wherein said needle cam means cooperates with said butt means on each needle, if any, not moved to the tuck position by its corresponding jack for moving such needle from the welt position rearwardly to the cast off position.

15. A combination according to claim 12, wherein said needle cam means cooperates with said butt means on each needle moved to the tuck position by its corresponding jack for moving each needle further forwardly from the tuck position to the clearing position and then from the clearing position rearwardly to the cast off position, and wherein said needle cam measn cooperates with said butt means on each needle not moved to the tuck position by its corresponding jack for moving such needle further forwardly from the welt position to the tuck position and then from the tuck position rearwardly to the cast off position.

16. A combination according to claim 12, wherein said cam assembly comprises a plurality of operative particular cam portions, each of said cam portions defining one yarn feed and including sufficient needle cam means, jack control cam means and pattern cam means for moving at least some of said pattern jacks and their corresponding needles through one cycle of their movement for knitting one course and for moving each of said active jacks through its movement cycle, each cycle beginning at the welt position; said pattern cam means of each said cam portion including at least one pattern cam segment for cooperating with said pattern butts on at least some of said pattern jacks for moving said jacks forwardly a sufficient distance to move their corresponding needles forwardly from the welt position to the tuck position; said needle cam means of at least some of said cam portions including at least one clearing cam segment for cooperating with said needle butt means on at least some of said needles brought to the tuck position by said moved jacks for moving said needles forwardly from the tuck position to the clearing position; said needle cam means of each said cam portion including at least one stitch cam segment for cooperating with said needle butt means on each needle corresponding to an active jack for moving said needle rearwardly to the cast off position from its respective forward position; and said control cam means of each cam portion including at least one welt cam segment for cooperating with said jack control butts on said active jacks for moving said active jacks forwardly a sufficient distance to move their corresponding needles from the cast off position to the welt position.

17. A combination according to claim 16, wherein said control cam means for each of said cam portions indludes a return cam segment for cooperating with said jack control butt on each active jack for moving said jack rearwardly from its forward position to return it to its rearward position no later than said stitch cam segment returns its corresponding needle to the cast off position.

18. A combination according to claim 16, wherein each of said pattern jacks provides a plurality of longitudinally spaced apart pattern butt sites, each jack having a pattern butt occupying at least one of said sites, the number of pattern butts and the sites which they occupy being independently selected for each jack, depending upon the pattern to be knit; each of said cam portions providing a plurality of longitudinally spaced apart pattern cam sites corresponding to said pattern butt sites, each of said cam portions having a pattern cam segment operatively occupying at least one of said pattern cam sites, the number of pattern cam segments and the pattern cam sites they occupy being independently selected for each said cam portion, depending upon the pattern being knit; and wherein, during the relative movement of said cam assembly and needle bed, each pattern cam segment of each said cam portion cooperates only with those pattern butts of the site corresponding to and aligned with the site of said pattern cam segment.

19. A combination according to claim 18, wherein each said cam portion is provided with a pattern cam segment operatively occupying each pattern cam site and means are provided for independently selectively removing each pattern cam segment from its operative position, to thereby select the pattern cam segments which will cooperate with selected pattern jacks.

20. A combination according to claim 19, wherein each said cam portion includes support means on which said pattern cam segments are mounted, said support means having a plurality of longitudinally spaced apart passageways extending transversely therethrough for defining said pattern cam sites; a pattern cam segment slidably mounted in each of said passageways, each of said pattern cam segments being independently slidable toward said needle bed to an operative position, slidably away from said needle bed to an inoperative position, or removable from said support; and means for maintaining each pattern cam segment in its operative or inoperative position.

21. A combination according to claim 19, wherein each said cam portion is provided with at least three pattern cam sites and each pattern jack is provided with at least three corresponding pattern butt sites.

22. A combination according to claim 21, wherein each of said cam portion includes a clearing cam segment, said clearing cam segment being selectively placeable in an operative position for cooperating with said needle butt means or removable from said operative position.

23. In a method of knitting with a multifeed knitting machine comprising a needle bed including laterally spaced apart longitudinally reciprocable jacks and longitudinally reciprocable needles corresponding to said jacks, the improvement comprising the steps of moving each of at least some of said jacks forwardly at least a respective predetermined distance, mechanically converting said forward jack movement of each moved jack while it is moving said respective predetermined distance into a respective second forwardly directed movement whose length depends on and is longer than the respective predetermined distance the jack moved, and mechanically applying said respective second movement resulting from each moved jack to its corresponding needle to move said corresponding needle forwardly a greater distance than said respective predetermined distance its jack was moved to move said needle forwardly at least a portion of the forward movement of its movement cycle.

24. A method of knitting according to claim 23, including the steps of continuing the forward movement of each of at least some of said moved needles, independently of its corresponding jack, forwardly through the remainder of the forward movement of its particular movement cycle, then moving each of said moved needles rearwardly to the cast off position, and returning each moved jack to its rearward position at a time no later than the time its corresponding needle is moved to the cast off position.

25. A method of knitting according to claim 24, wherein said jacks are moved forwardly by applying camming forces to said jacks, said needles whose forward movement is continued are so moved forwardly by applying needle camming forces thereto independently of said jacks, and each of said moved needles are moved rearwardly to the cast off position by applying other needle camming forces thereto.

26. A method of knitting according to claim 25, wherein said application of said second movement to its corresponding needle moves at least some of said needles from at least the welt position to at least about the tuck position.

27. A method of knitting according to claim 25, wherein each needle to be moved forwardly is at the welt position; wherein said camming forces applied to said jacks include first and second camming forces; wherein said second camming forces are applied to each jack corresponding to a needle to be moved to move said jack forwardly a distance sufficient for the corresponding second movement to move the needle corresponding to said jack from the welt position to at least the tuck position; and wherein, after said other needle camming forces have been applied to move said moved needles rearwardly to the cast off position, said first camming forces are applied to said moved jacks to move them forwardly a distance sufficient for the corresponding second movement to move the needles corresponding to said jacks forwardly to the welt position.

28. A method of knitting according to claim 27, wherein said second camming forces move said jacks moved thereby forwardly sufficiently to cause their corresponding needles to move from the welt position to only the tuck position.

29. A method of knitting according to claim 28, wherein said first camming forces are applied to each moved jack to move its corresponding needle from the cast off position to the welt position.

30. A method of knitting according to claim 29, wherein said needle camming forces include third camming forces and said third camming forces are applied, independently of the jacks, to at least some of said needles which have been moved to the tuck position by said second camming forces acting on their corresponding jacks, said third camming forces moving the needles moved thereby forwardly from the tuck position to the clearing position.

31. A method of knitting according to claim 30, wherein said other needle camming forces include fourth camming forces and said fourth camming forces are applied to at least each of said moved needles to move it rearwardly from its forward position to the cast off position.

32. A method of knitting according to claim 31, wherein a plurality of particular courses are knit and wherein at least some of said jacks are active jacks for being moved through a movement cycle in each of said particular courses, the movement cycle of the corresponding needles beginning at the welt position; wherein in each of said particular courses said second camming forces are applied to at least some of said active jacks whereby their corresponding needles are moved forwardly from the welt position to the tuck position; wherein in at least some of said particular courses said third camming forces are applied to at least some of the needles moved to the tuck position by the application of said second forces to their corresponding jacks, to move such needles forwardly from the tuck position to the clearing position; wherein in each said particular course said fourth camming forces are applied to each needle corresponding to an active jack to move each such needle rearwardly to the cast off position from its respective forward position; and wherein said first camming forces are applied to each active jack to move its corresponding needle forwardly from the cast off position to the welt position.

33. A method of knitting according to claim 32, wherein in each of said particular courses return camming forces are applied to each of said active jacks to move it rearwardly from its forward position at a time no later than the time its corresponding needle is moved to the cast off position.

34. A method of knitting according to claim 33, wherein in each of said particular courses the jacks to which said second camming forces are applied are independently selected.

35. In a multifeed knitting machine, a. a needle bed having a plurality of laterally spaced apart longitudinally extending grooves, an active jack and a needle corresponding thereto slidably positioned in each of at least some of said grooves for forward-rearward reciprocation, each needle having outwardly extending butt means, and each active jack having at least one outwardly extending control butt, at least some of said active jacks being pattern jacks having at least one outwardly extending pattern butt longitudinally spaced apart from said control butt, b. a cam assembly, c. means for causing relative lateral movement between said needle bed and said cam assembly to operate said active jacks and their corresponding needles;

d. said cam assembly comprising a plurality of operative particular cam portions, each of said cam portions defining one yarn feed and including sufficient needle cam means, jack control cam means and pattern cam means for moving at least some of said pattern jacks and their corresponding needles through one cycle of their movement for knitting one course and for moving each of said active jacks through its movement cycle, each cycle beginning at the welt position;

e. said pattern cam means of each said cam portion including at least one pattern cam segment for cooperating with said pattern butts on at least some of said pattern jacks for moving said jacks forwardly a sufficient distance to move their corresponding needles forwardly from the welt position to the tuck position;

f. said needle cam means of at least some of said cam portions including at least one clearing cam segment for cooperating with said needle butt means on at least some of said needles brought to the tuck position by said moved jacks for moving said needles forwardly from the tuck position to the clearing position;

g. said needle cam means of each said cam portion including at least one stitch cam segment for cooperating with said needle butt means on each needle corresponding to an active jack for moving said needle rearwardly to the cast off position from its respective forward position;

h. and said control means of each cam portion including at least one welt cam segment for cooperating with said jack control butts on said active jacks for moving said active jacks forwardly a sufficient distance to move their corresponding needles from the cast off position to the welt position.

36. A combination according to claim 35, wherein said control cam means for each of said cam portions includes a return cam segment for cooperating with said jack control butt on each active jack for moving said jack rearwardly from its forward position to return it to its rearward position no later than said stitch cam segment returns its corresponding needle to the cast off position.

37. A combination according to claim 36, wherein each of said pattern jacks provides a plurality of longitudinally spaced apart pattern butt sites, each jack having a pattern butt occupying at least one of said sites, the number of pattern butts and the sites which they occupy being independently selected for each jack, depending upon the pattern to be knit; each of said cam portions providing a plurality of longitudinally spaced apart pattern cam sites corresponding to said pattern butt sites, each of said cam portions having a pattern cam segment operatively occupying at least one of said pattern cam sites, the number of pattern cam segments and the pattern cam sites they occupy being independently selected for each said cam portion, depending upon the pattern being knit; and wherein, during the relative movement of said cam assembly and needle bed, each pattern cam segment of each said cam portion cooperates only with those pattern butts at the site corresponding to and aligned with the site of said pattern cam segment.

38. A combination according to claim 37, wherein each said cam portion is provided with a pattern cam segment operatively occupying each pattern cam site and means are provided for independently selectively removing each pattern cam segment from its operative position, to thereby select the pattern cam segments which will cooperate with selected pattern jacks.

39. A combination according to claim 38, wherein each said cam portion includes support means on which said pattern cam segments are mounted, said support means having a plurality of longitudinally spaced apart passageways extending transversely therethrough for defining said pattern cam sites; a pattern cam segment slidably mounted in each of said passageways, each of said pattern cam segments being independently slidable toward said needle bed to an operative position, slidable away from said needle bed to an inoperative position, or removable from said support; and means for maintaining each pattern cam segments in its operative or inoperative position.

40. A knitting cam construction comprising at least one cam portion defining one yarn feed and having sufficient cam means for cooperating with needle and jack butt means for moving needles corresponding thereto longitudinally forwardly and rearwardly through one movement cycle for knitting one course, said cam portion comprising, a. a cam support having an inner face and an outer face, b. said cam support having a plurality of longitudinally spaced apart passageways extending transversely therethrough from said inner face to said outer face, each passageway defining a pattern cam site for slidably receiving a pattern cam segment therein for sliding movement between an operative position and an inoperative position, c. a plurality of pattern cam segments, each segment having an inner end and an outer end, d. each pattern cam segment having adjacent its inner end a camming surface oblique to the longitudinal direction, e. said pattern cam segment being in said operative position in a pattern cam site when said inner end and said camming surface project from said inner face of said cam support sufficiently for said camming surface to cooperate with said butt means, f. said pattern cam segment being in said inoperative position in a pattern cam site when said inner end and said camming surface have been moved toward the outer face of said cam support sufficiently to prevent said camming surface from cooperating with said butt means, g. each camming segment at a pattern cam site being movable between said operative and inoperative positions, independently of camming segments at other sites, h. cooperating means on said pattern cam segments and said cam support for maintaining each cam segment in its respective operative or inoperative positions, i. each camming surface in the operative position cooperating with butt means on at least selected jacks for moving them forwardly sufficiently to move the needles corresponding thereto forwardly from at least the welt position to the tuck position, said cam sites and cam segments therein defining a multiple patterning raceway, j. needle cam means longitudinally spaced apart from said multiple patterning raceway, said needle cam means including (A) at least one clearing cam segment for cooperating with butt means on at least some of the needles brought to the tuck position by a pattern cam segment for moving said needles from the tuck position to the clearing position, and (B) at least one stitch cam segment for cooperating with butt means on needles for moving them rearwardly to the cast off position form their respective forward positions.

41. A combination according to claim 16, wherein said needle cam means of at least selected particular cam portions cooperates with needle butt means on each of said needles brought to the tuck position by said moved jacks for moving said needles forwardly from the tuck position to the clearing position.

42. A combination according to claim 41, wherein said needle cam means of at least one of said selected partucular cam portions also includes a tucking cam segment for cooperating with said needle butt means on each needle corresponding to an active jack not moved to the tuck position by its corresponding jack for moving such needle from the welt position to the tuck position, said stitch cam segment then moving each needle so tucked from the tuck position rearwardly to the cast off position.

43. A combination according to claim 41, wherein in at least some of said selected particular cam portions, said pattern cam means cooperates with pattern butts on pattern jacks corresponding only to selected needles for moving said jacks forwardly a sufficient distance to move the selected needles forwardly from the welt position to the tuck position, the non-selected needles not being moved forwardly from the welt position by said cam portion.

44. A combination according to claim 41, wherein there is at least one particular cam portion whose needle cam means does not include a clearing cam segment, and whose pattern cam means cooperates with pattern butts on pattern jacks corresponding only to selected needles for moving said jacks forwardly a sufficient distance to move the selected needles forwardly from the welt position to the tuck position, said cam portion having no means for moving the selected and non-selected needles forwardly past their respective tuck and welt positions.

45. A method of knitting according to claim 24, wherein a plurality of particular courses are knit and wherein at least some of said jacks are active jacks for being moved through a movement cycle in each of said particular courses, the movement cycle of the corresponding needles beginning at the welt position; wherein in each of said particular courses at least some of said active jacks are moved forwardly sufficiently for the corresponding second movements to move their corresponding needles forwardly from the welt position to the tuck position; wherein in at least selected particular courses each of said needles moved to the tuck position by its corresponding jack is further moved forwardly from the tuck position to the clearing position independently of its correspondiing jack, and in the non-selected particular courses, if any, each needle moved to the tuck position by its corresponding jack is not moved forwardly beyond the tuck position; and wherein in each of said particular courses each active jack and each needle corresponding thereto is moved rearwardly to the cast off position from its respective forward position and each active jack is subsequently moved forwardly sufficiently for the corresponding second movement to move its corresponding needle forwardly from the cast off position to the welt position.

46. A method of knitting according to claim 45, wherein in each of said particular courses the jacks which are moved forwardly sufficiently to move their corresponding needles from the welt position to the tuck position are independently selected.

47. A method of knitting according to claim 46, wherein in each of said particular courses each active jack is moved rearwardly to the cast off position independently of its corresponding needle at a time no later than its corresponding needle is moved to the cast off position.

48. A method of knitting according to claim 46, wherein in at least one of said selected particular courses, only selected active jacks are moved forwardly sufficiently to move their corresponding needles from the welt position to the tuck position, and the needles corresponding to the non-selected jacks are moved, independently of their jacks, from the welt position to the tuck position and are not moved forwardly from the tuck position in said course.

49. A method of knitting according to claim 46, wherein in at least some of said selected particular courses, only selected active jacks are moved forwardly sufficiently to move their corresponding needles from the welt position to the tuck position, the needles corresponding to the non-selected jacks not being moved forwardly from the welt position in said some selected particular courses.

50. A method of knitting according to claim 46, wherein said particular courses include selected and non-selected particular courses, and wherein at least some of said non-selected particular courses only selected active jacks are moved forwardly sufficiently to move their corresponding needles from the welt position to the tuck position, the needles corresponding to the non-selected jacks not being moved forwardly from the welt position in said non-selected particular courses.

51. A knitting cam construction according to claim 40, including a control raceway having therein jack welt cam means for cooperating with butt means on at least said moved jacks for moving them forwardly a sufficient distance to move their corresponding needles from rearward of the welt position to the welt position after they have been brought to the cast off position.

52. A knitting cam construction according to claim 51, wherein said clearing cam segment is selectively movable between an operative position and an inoperative position.

53. A knitting cam construction according to claim 52, wherein said control raceway includes jack return cam means for cooperating with butt means on each of said moved jacks for moving said jack rearwardly from its forward position to return it to its rearward position no later than said stitch cam segment returns its corresponding needle to the cast off position.

54. In a multifeed knitting machine, a needle bed, a plurality of spaced apart jacks and needles corresponding thereto mounted on said bed for forward-rearward reciprocation, and a mechanical movement multiplier means in said bed between each of at least some of said jacks and its corresponding needle for mechanically receiving the forward movement of the jack and mechanically transmitting the movement to its corresponding needle while mechanically multiplying the forward length thereof to move the needle forwardly a greater distance than the jack moved forwardly while its movement was being transmitted.

* * * * *